US008464438B2

(12) United States Patent
Fujikura et al.

(10) Patent No.: US 8,464,438 B2
(45) Date of Patent: Jun. 18, 2013

(54) SEASONING APPARATUS

(75) Inventors: Tatsuo Fujikura, Kanagawa-ken (JP); Yuhei Chiwata, Kanagawa-ken (JP); Masahiko Kondou, Kanagawa-ken (JP); Hiroyuki Asakura, Minami-Ashigara (JP)

(73) Assignee: FUJIFILM Corporation, Tokyo (JP)

( * ) Notice: Subject to any disclaimer, the term of this patent is extended or adjusted under 35 U.S.C. 154(b) by 289 days.

(21) Appl. No.: 13/044,136

(22) Filed: Mar. 9, 2011

(65) Prior Publication Data

US 2011/0219641 A1 Sep. 15, 2011

(30) Foreign Application Priority Data

Mar. 10, 2010 (JP) ..... 2010-053252

(51) Int. Cl.
*F26B 13/06* (2006.01)

(52) U.S. Cl.
USPC ..... 34/619; 34/623; 34/629; 34/631; 34/632; 34/639; 399/76; 399/209; 271/90; 271/171; 347/104; 427/8; 427/511; 250/453.11

(58) Field of Classification Search
USPC ..... 34/104, 115, 121, 619, 623, 629, 34/631, 632, 639, 640; 399/76, 209, 353; 271/4.08, 90, 161, 171, 170; 347/104; 427/8, 427/511; 250/453.11
See application file for complete search history.

(56) References Cited

U.S. PATENT DOCUMENTS

| | | | | | |
|---|---|---|---|---|---|
| 1,753,828 | A | * | 4/1930 | Greer et al. | 34/223 |
| 2,022,593 | A | * | 11/1935 | Fuykers | 34/444 |
| 2,042,145 | A | * | 5/1936 | Darrah | 34/250 |
| 2,542,089 | A | * | 2/1951 | Leifer | 270/58.29 |
| 3,873,196 | A | * | 3/1975 | Ogawa | 399/76 |
| 4,365,423 | A | * | 12/1982 | Arter et al. | 34/463 |
| 4,924,599 | A | * | 5/1990 | Bubley | 34/278 |
| 5,604,990 | A | * | 2/1997 | Takekoshi | 34/68 |

(Continued)

FOREIGN PATENT DOCUMENTS

| | | |
|---|---|---|
| DE | 2204991 A1 | 8/1973 |
| EP | 2347980 A2 | 7/2011 |

(Continued)

*Primary Examiner* — Stephen M. Gravini
(74) *Attorney, Agent, or Firm* — Birch, Stewart, Kolasch & Birch, LLP

(57) ABSTRACT

A seasoning apparatus includes: a table on which a stack of paper sheets is loaded; a ceiling plate which is arranged above the table to cover an upper side of the paper stack on the table; a front side plate and a rear side plate which are arranged to oppose to each other at front and rear sides of the paper stack on the table, at least one of the front and rear side plates being advanceable and retractable relatively to each other; a right-hand side plate and a left-hand side plate which are arranged to oppose to each other at a right-hand side and a left-hand side of the paper stack on the table, at least one of the right-hand and left-hand side plates being advanceable and retractable relatively to each other; and an air blowing device which blows air horizontally toward the paper stack on the table.

10 Claims, 19 Drawing Sheets

U.S. PATENT DOCUMENTS

| | | | | |
|---|---|---|---|---|
| 2005/0138832 | A1* | 6/2005 | Hada et al. | 34/122 |
| 2005/0246918 | A1* | 11/2005 | Tanahashi et al. | 34/80 |
| 2007/0051009 | A1* | 3/2007 | Hada et al. | 34/115 |
| 2008/0010853 | A1* | 1/2008 | Mann et al. | 34/376 |
| 2011/0175278 | A1* | 7/2011 | Fujikura et al. | 271/90 |
| 2011/0181676 | A1* | 7/2011 | Chiwata | 347/104 |
| 2011/0219641 | A1* | 9/2011 | Fujikura et al. | 34/619 |
| 2013/0004652 | A1* | 1/2013 | Furukawa | 427/8 |

FOREIGN PATENT DOCUMENTS

| | | | |
|---|---|---|---|
| JP | 10-297813 | A | 11/1998 |
| JP | 2001-63019 | A | 3/2001 |
| JP | 2005-75541 | A | 3/2005 |
| JP | 2008-30903 | A | 2/2008 |

* cited by examiner

SEASONING APPARATUS

BACKGROUND OF THE INVENTION

1. Field of the Invention

The present invention relates to a seasoning apparatus, and more particularly to a seasoning apparatus which seasons a stack of cut sheets of paper.

2. Description of the Related Art

In a printing system which prints on general printing paper using water-based ink, deformation including expansion and contraction occurs in the sheet of paper due to change in the amount of water in the sheet of paper, and registration errors between the front and back surfaces of the sheet of paper occur in the case of double-side printing, and so on. In order to prevent this, it is necessary to season the sheet of paper immediately after printing so as to adapt the sheet of paper to the ambient temperature and humidity.

Japanese Patent Application Publication No. 2001-063019 discloses technology in which a sheet of paper that has been printed on one surface is output temporarily to an external paper output tray and dried by blowing air on the paper output tray, whereupon printing of the back surface is carried out. However, the paper needs to be processed one sheet at a time, and hence entails a drawback in that processing requires a large amount of time if a large number of prints are made at the same time.

When printing of many sheets of paper is carried out at the same time, it might be considered efficient if, firstly, printing is performed on one surface of each of the paper sheets, the paper sheets which have completed printing on the one surface are collected and seasoned together, and then printing is performed on the back surface of each of the paper sheets. However, when the paper sheets are stacked together, the surface area contacting with the air decreases, and hence there is a problem in that seasoning requires time.

A possible method for efficiently seasoning paper sheets which have been stacked together is a method where ambient air is blown from a side of the paper sheets in a stacked state (paper stack) so as to pass air between the paper sheets, thereby promoting seasoning. In this case, in order to prevent the paper sheets from being blown away, it is necessary to surround the periphery of the paper stack with side plates. Furthermore, in order to perform efficient seasoning, it is necessary to enclose the periphery of the paper stack to a certain extent so as to control the flow of air.

Japanese Patent Application Publication No. 10-297813 relates to technology for separating a stack of paper sheets, and describes technology in which the periphery of a paper stack is enclosed by side plates and air is blown from the sides of the paper stack.

With a composition where the periphery of a paper stack is surrounded with side plates, if the side plates are disposed at a distance from the side faces of the paper stack, then there are problems in that the paper sheets become disordered after the end of seasoning and the recovery process requires work. If, on the other hand, the side plates are disposed in close contact with each side face of the paper stack, then there is a problem in that the edges of the paper sheets rub against the side plates during seasoning, creases occur in the paper sheets, and so on. Hence, it is desirable that each side plate is disposed in a position at a prescribed distance (e.g., approximately 3 mm) from each side face of the paper stack.

However, there are many different sizes of paper and if the side plates are to be set so as to match each size of paper, then a problem arises in that a seasoning apparatus must be prepared separately for each size of paper.

On the other hand, although it is possible to position the side plates in accordance with the paper of maximum size and to employ a size adjustment mechanism as used in a generic copying machine, or the like, such size adjusting mechanisms are not able to airtightly enclose the periphery of the paper stack and therefore it is not possible to pass air efficiently between the paper sheets if the mechanism is used directly without modification, and hence there is a drawback in that desired seasoning performance cannot be displayed.

SUMMARY OF THE INVENTION

The present invention has been contrived in view of these circumstances, an object thereof being to provide a seasoning apparatus capable of seasoning stacks of paper sheets of various different sizes with a single apparatus.

In order to attain the aforementioned object, the present invention is directed to a seasoning apparatus, comprising: a table having a loading surface on which a stack of paper sheets is loaded; a ceiling plate which is arranged above the loading surface to cover an upper side of the stack of paper sheets loaded on the loading surface; a front side plate and a rear side plate which are arranged to oppose to each other at a front side and a rear side of the stack of paper sheets loaded on the loading surface, at least one of the front side plate and the rear side plate being advanceable and retractable relatively to each other; a right-hand side plate and a left-hand side plate which are arranged to oppose to each other at a right-hand side and a left-hand side of the stack of paper sheets loaded on the loading surface, at least one of the right-hand side plate and the left-hand side plate being advanceable and retractable relatively to each other; and an air blowing device which blows air horizontally toward the stack of paper sheets loaded on the loading surface.

According to this aspect of the present invention, the front side plate and the rear side plate which are arranged at the front and rear sides of the stack of paper sheets, and the right-hand side plate and the left-hand side plate which are arranged to the right-hand side and the left-hand side of the stack of paper sheets, are respectively arranged so as to be relatively advanceable and retractable. Thus, it is possible to arrange the side plates suitably in accordance with the size of paper, and seasoning of stacks of paper sheets of various different sizes can be performed efficiently.

Preferably, the seasoning apparatus further comprises a horizontal base, wherein: the ceiling plate is fixed to the base; and the table is slidable horizontally with respect to the base.

According to this aspect of the present invention, the ceiling plate is fixed to the base, and the table is slidable horizontally with respect to the base on which the ceiling plate is fixed. In other words, the table can be pulled out. Thus, it is possible to expose the upper part of the table readily, and therefore a paper stack can be introduced and removed easily.

Preferably, at least a part of the loading surface is formed so as to be inclined one of rightward and leftward; and the air blowing device blows air horizontally toward the stack of paper sheets loaded on the loading surface from the rear side of the stack of paper sheets loaded on the loading surface.

According to this aspect of the present invention, all or a part of the loading surface of the table is formed so as to be inclined leftward or rightward, and the air flow is blown from the rear side of the stack of paper sheets loaded on the loading surface. Thus, it is possible to pass the air flow efficiently between the paper sheets, and furthermore the paper sheets can be ordered when seasoning is completed.

Preferably, the loading surface is formed so as to be curved rightward and leftward; and the air blowing device blows air horizontally toward the stack of paper sheets loaded on the loading surface from the rear side of the stack of paper sheets loaded on the loading surface.

According to this aspect of the present invention, the loading surface of the table is formed so as to curve leftward and rightward, and the air flow is blown from the rear side of the stack of paper sheets loaded on the loading surface. Thus, it is possible to pass the air flow efficiently between the paper sheets.

Preferably, the rear side plate is fixed to the table; and the front side plate is advanceable and retractable with respect to the rear side plate.

According to this aspect of the present invention, the rear side plate is fixed to the table and the front side plate is advanceable and retractable with respect to the rear side plate. By adjusting the size with reference to one side plate in this way, it is possible to register the stack of paper sheets in a prescribed position, and the front-rear size adjustment can be performed easily.

Preferably, one of the left-hand side plate and the right-hand side plate is fixed to the table; and the other of the left-hand side plate and the right-hand side plate is advanceable and retractable with respect to the fixed one of the left-hand side plate and the right-hand side plate.

According to this aspect of the present invention, the left-hand side plate or the right-hand side plate is fixed to the table, and the movable one of these plates is advanceable and retractable with respect to the fixed one of these plates. For example, if the left-hand side plate is fixed, then the right-hand side plate is arranged advanceably and retractably with respect to the left-hand side plate. By adjusting the size reference to one side plate in this way, it is possible to register the stack of paper sheets in a prescribed position, and the right-left size adjustment can be performed easily.

It is also preferable that both the left-hand side plate and the right-hand side plate are mutually advanceable and retractable.

According to this aspect of the present invention, both the left-hand side plate and the right-hand side plate are arranged in mutually advanceable and retractable fashion. Thus, it is possible to simply perform the right-left size adjustment.

Preferably, the air blowing device blows air horizontally toward the stack of paper sheets loaded on the loading surface from the rear side of the stack of paper sheets loaded on the loading surface; and an opening section through which the air blown from the air blowing device exits is formed in the front side plate.

According to this aspect of the present invention, the air flow is blown from the rear side of the stack of paper sheets loaded on the loading surface, and an exit path for the air flow is formed on the front side (namely, an opening section is arranged in the front side plate). Thus, it is possible to pass the air flow efficiently between the paper sheets, and all of the paper sheets can be seasoned efficiently.

Preferably, an interval between the front side plate and the rear side plate and an interval between the left-hand side plate and the right-hand side plate are variable in accordance with preset paper widths.

According to this aspect of the present invention, the interval between the front side plate and the rear side plate and the interval between the left-hand side plate and the right-hand side plate can be varied in accordance with a previously established paper width. Thus, it is possible to set up the respective side plates readily in correct positions.

In order to attain the aforementioned object, the present invention is also directed to a seasoning apparatus, comprising a plurality of the above described seasoning apparatuses which are stacked to each other.

According to this aspect of the present invention, since the plurality of seasoning apparatuses are stacked, it is then possible to season a plurality of stacks of paper simultaneously, without occupying extra installation space.

According to the present invention, it is possible to season stacks of paper of various different sizes, with one apparatus.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

Figure 1:
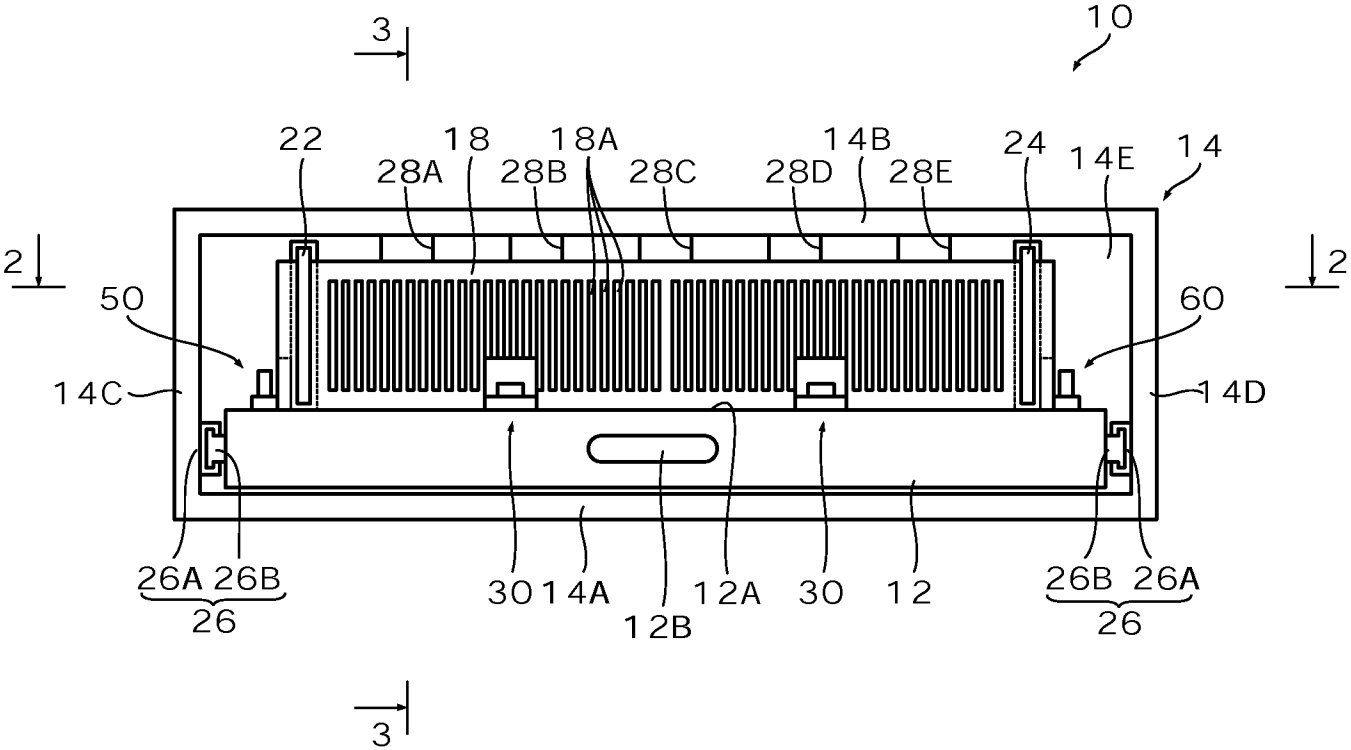
FIG. 1 is a front view diagram of a seasoning apparatus according to a first embodiment of the present invention.
Figure 2:
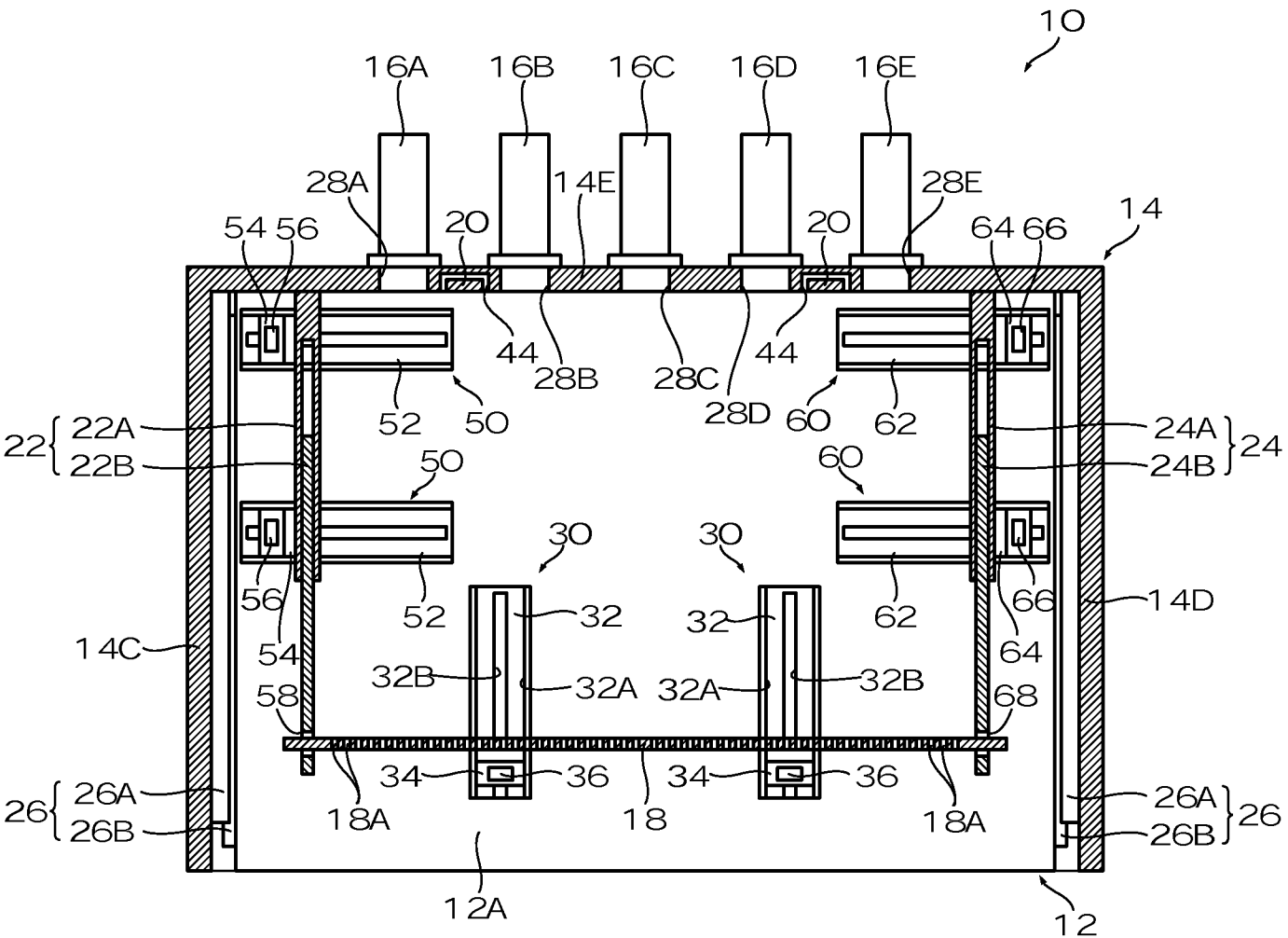
FIG. 2 is a cross-sectional view along line 2-2 in FIG. 1.
Figure 3:
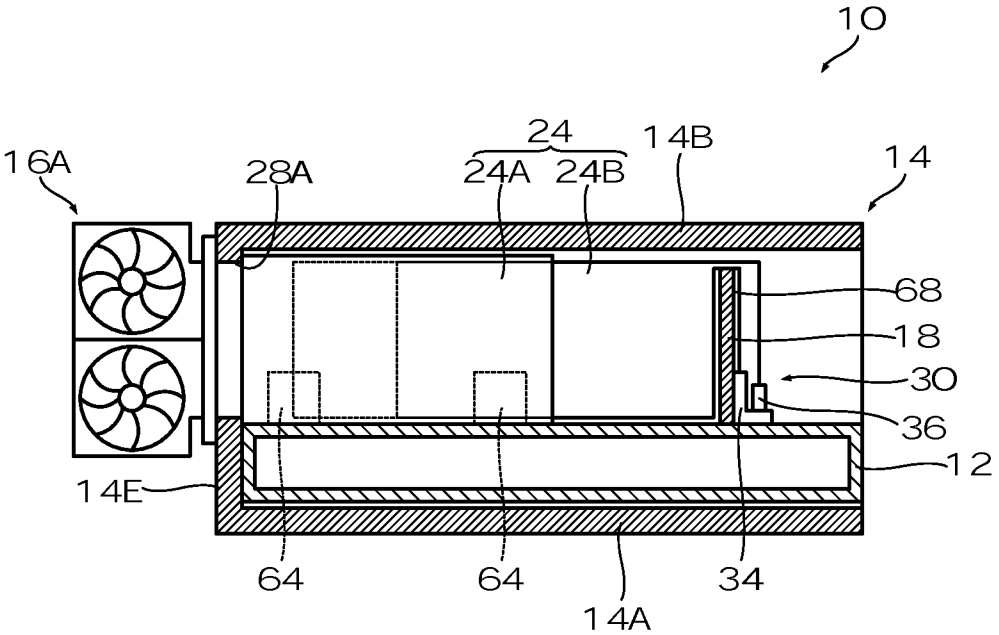
FIG. 3 is a cross-sectional view along line 3-3 in FIG. 1.

FIG. 1 is a front diagram of a seasoning apparatus according to a first embodiment of the present invention, and FIGS. 2 and 3 are cross-sectional diagrams respectively along lines 2-2 and 3-3 in FIG. 1.

As shown in these drawings, the seasoning apparatus 10 includes: a table 12, on which a paper stack S (shown in FIGS. 5A and 5B) is loaded; a casing 14, which accommodates the table 12, a plurality of air blowers 16A, 16B, 16C, 16D and 16E, which blow ambient air toward the paper stack S; and side plates including a front side plate 18, a rear side plate 14E, a left-hand side plate 22 and a right-hand side plate 24, which surround the paper stack S.

The table 12 is formed in a rectangular plate shape, and the upper surface thereof serves as a horizontal loading surface 12A. The paper stack S or stacked sheets of paper is loaded onto the loading surface 12A of the table 12. A gripper section 12B is formed on the front face of the table 12.

The casing 14 is formed in a rectangular box shape, which is open on the front face thereof, and the table 12 is accommodated in the casing 14. The casing 14 includes: a base section 14A, which constitutes a lower surface of the casing 14; a ceiling section 14B, which constitutes an upper surface of the casing 14; a left-hand side section 14C, which constitutes a left-hand surface of the casing 14; a right-hand side section 14D, which constitutes a right-hand surface of the casing 14; and a rear side section 14E, which constitutes a rear surface of the casing 14.

The base section 14A is formed in a rectangular plate shape and is made to a size capable of accommodating the table 12. The ceiling section 14B is formed in a rectangular plate shape of the same size as the base section 14A, and is disposed in parallel with the base section 14A. The left-hand side section 14C is formed in a rectangular plate shape and is erected perpendicularly on the left-hand side portion of the base section 14A to have a prescribed height. The right-hand side section 14D is formed in a rectangular plate shape and is erected perpendicularly on the right-hand side portion of the base section 14A to have a prescribed height. The rear side section 14E is formed in a rectangular plate shape and is erected perpendicularly on the rear side portion of the base section 14A to have a prescribed height. As described below, in the seasoning apparatus 10 according to the present embodiment, the rear side section 14E constitutes a rear side plate among the side plates surrounding the periphery of the paper stack S.

A pair of table guides 26, which guide the table 12 for the accommodation into the casing 14, are installed on the inner wall surfaces of the left-hand side section 14C and the right-hand side section 14D of the casing 14. Each of the table guides 26 includes a rail 26A and a slider 26B, which is supported slidably on the rail 26A. The rails 26A are installed on the inner wall surfaces of the left-hand side section 14C and the right-hand side section 14D of the casing 14, so as to be parallel to the base section 14A of the casing 14. On the other hand, the sliders 26B are installed on the left-hand side face and the right-hand side face of the table 12, so as to be parallel to the loading surface 12A of the table 12. Thus, the table 12 is installed slidably in a horizontal direction with respect to the casing 14, and the table 12 can be pulled out from the casing 14. The sliders 26B are provided with a stopper (not shown) to prevent the table 12 from being pulled out over a prescribed amount with respect to the rails 26A.

The air blowers 16A to 16E are installed horizontally at uniform intervals on the rear side section 14E of the casing 14. Each of the air blowers 16A to 16E is constituted of two fans (in the present embodiment, sirocco fans), which are stacked in the vertical direction, and blow ambient air horizontally toward the front side of the casing 14.

Air blowing opening sections 28A, 28B, 28C, 28D and 28E corresponding to the shape of the outlet ports of the air blowers 16A to 16E are formed at uniform intervals apart (the arrangement intervals of the air blowers 16A to 16E) in the rear side section 14E of the casing 14. The air blowers 16A to 16E are installed on the rear side section 14E of the casing 14 with the outlet ports thereof accommodated in the air blowing opening sections 28A to 28E, respectively.

When the air blowers 16A to 16E thus installed are driven, then ambient air flows are blown out horizontally from the air blowing opening sections 28A to 28E. The ambient air flows blown out from the air blowing opening sections 28A to 28E pass through the interior of the casing 14, and exit the casing 14 through the opening on the front side of the casing 14.

The driving of each of the air blowers 16A to 16E can be controlled individually by a controller (not shown). The controller controls the driving of the air blowers 16A to 16E on the basis of operational information from an operating unit (not shown).

The side plates are constituted of: the front side plate 18, which is arranged opposing the front side face of the paper stack S loaded on the table 12; the rear side plate 14E, which is arranged opposing the rear side face of the paper stack S loaded on the table 12; the left-hand side plate 22, which is arranged opposing the left-hand side face of the paper stack S loaded on the table 12; and the right-hand side plate 24, which is arranged opposing the right-hand side face of the paper stack S loaded on the table 12. The front side plate 18 and the rear side plate 14E are arranged to oppose to each other, and the left-hand side plate 22 and the right-hand side plate 24 are arranged to oppose to each other. The left-hand side plate 22 and the right-hand side plate 24 are arranged perpendicularly with respect to the front side plate 18 and the rear side plate 14E. Thus, a rectangular enclosed space is formed by the front side plate 18, the rear side plate 14E, the left-hand side plate 22 and the right-hand side plate 24.

The front side plate 18 is formed in a rectangular plate shape having a prescribed width, and is formed to substantially the same height as the height from the loading surface 12A of the table 12 to the ceiling section 14B of the casing 14. The front side plate 18 is arranged opposing the rear side section (rear side plate) 14E of the casing 14, and is supported movably in the front-rear direction of the table 12 (so as to be advanceable and retractable with respect to the rear side section (rear side plate) 14E of the casing 14) by means of a pair of front side plate guides 30.

Each of the front side plate guides 30 includes a rail unit 32, a slide unit 34, which is guided linearly by the rail unit 32, and a fixing knob 36, which fixes the slide unit 34.

As shown in FIG. 2, each of the rail units 32 is formed in a rectangular plate shape extending in the guide direction, and is arranged in the guiding direction (here, the front-rear direction of the table 12 (a direction perpendicular to the front side plate 18)). A guide groove 32A having a prescribed width and prescribed depth is formed in the lengthwise direction at a central position in the upper face (guide face) of each rail unit 32. An elongated guide hole 32B is formed in the lengthwise direction in the bottom section of the guide groove 32A. The rail units 32 are embedded in the loading surface of the table 12, and the upper faces (guide faces) of the rail units 32 are flush with the loading surface 12A of the table 12.

Figure 4A:
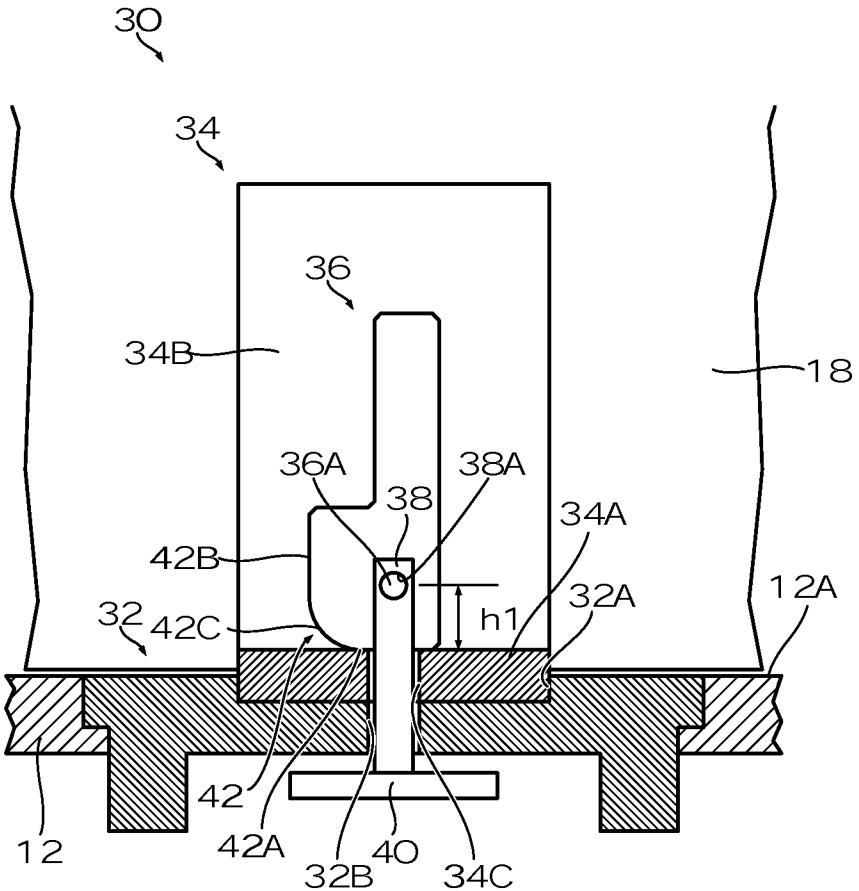
FIGS. 4A and 4B are front view cross-sectional diagrams showing the composition of a front side plate guide.
Figure 4B:
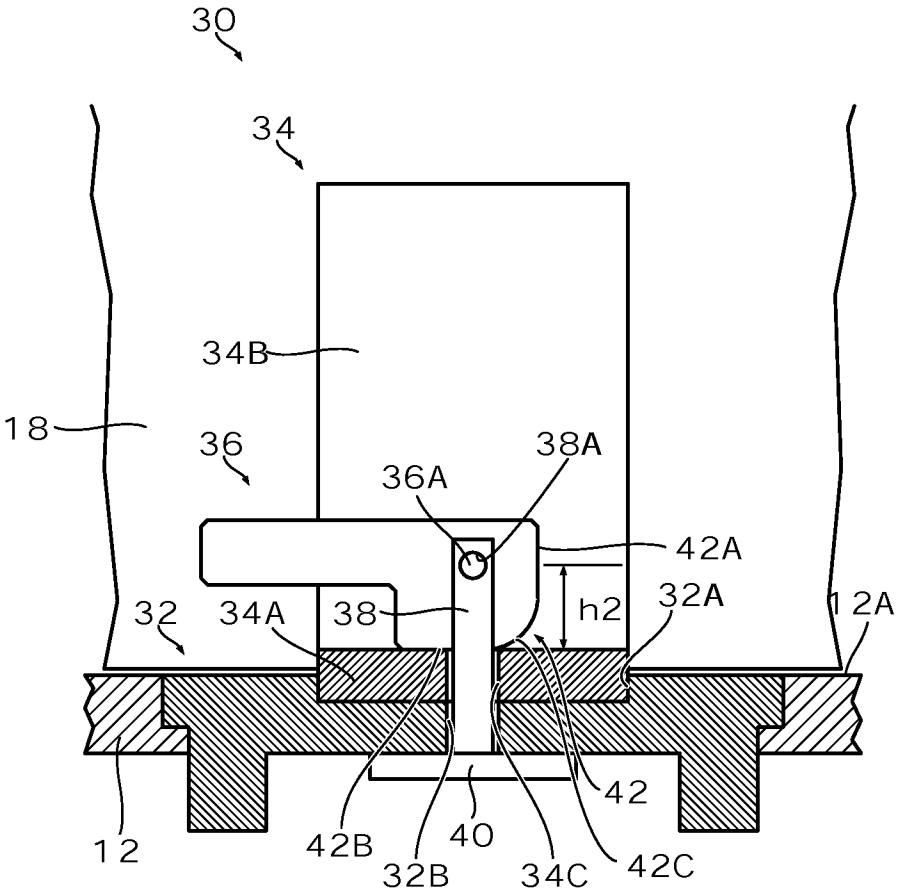

As shown in FIGS. 4A and 4B, each of the slide units 34 is formed in an L shape, which is constituted of a horizontal section 34A formed in a horizontal plate shape and a vertical section 34B formed in a vertical plate shape. The horizontal section 34A is formed so as to correspond to the width of the guide groove 32A formed in the rail unit 32, and a horizontal sliding face is formed on the bottom face of the horizontal section 34A. The slide units 34 are supported movably in the prescribed directions while being guided by the guide grooves 32A, by means of the horizontal sections 34A fitting into the guide grooves 32A of the rail units 32. A through hole 34C having substantially the same diameter as the width of the guide hole 32B is formed in each horizontal section 34A so as to correspond to the guide hole 32B formed in the rail unit 32. The vertical section 34B is erected perpendicularly on an end of the horizontal section 34A. The vertical section 34B functions as a supporting section for the guided member, and the front side plate 18 is attached on the vertical section 34B.

The fixing knob 36 is formed in a bar shape, and a swinging axle 36A is arranged horizontally in the base end section of the fixing knob 36. The fixing knob 36 is supported swingably on the upper end portion of a guide shaft 38 through the swinging axle 36A.

The guide shaft 38 is formed to substantially the same diameter as the inner diameter of the through hole 34C formed in the horizontal section 34A, and is arranged vertically by passing through the through hole 34C and the guide hole 32B. A stopper plate 40 formed in a plate shape is attached horizontally on the lower end of the guide shaft 38. The swinging axle 36A of the fixing knob 36 is inserted in a bearing hole 38A formed in the upper end portion of the guide shaft 38, whereby the fixing knob 36 is supported swingably on the upper end portion of the guide shaft 38.

An abutting surface 42 which abuts with the upper surface of the horizontal section 34A of the slide unit 34 is formed on the base end portion of the fixing knob 36, which is supported swingably on the upper end portion of the guide shaft 38 as described above. The abutting surface 42 constitutes a base end surface of the fixing knob 36, and includes a first surface 42A which abuts against the upper surface of the horizontal section 34A when the fixing knob 36 is in an upright position, a second surface 42B which is perpendicular to the first surface 42A and which abuts against the upper surface of the horizontal section 34A when the fixing knob 36 is in a lowered position, and a circular arc-shaped surface 42C which links together the first surface 42A and the second surface 42B. The first surface 42A and the second surface 42B, which constitute the abutting surface 42, are at different distances from the swinging axle 36A (in terms of lengths of normal lines which extend perpendicularly from the first and second surfaces 42A and 42B to the swinging axle 36A) and the distance h2 from the second surface 42B to the swinging axle 36A is longer than the distance h1 from the first surface 42A to the swinging axle 36A.

Hence, as shown in FIG. 4B, when the fixing knob 36 is lowered, the guide shaft 38 is pulled up and the horizontal section 34A of the slide unit 34 and the rail unit 32 are gripped between the fixing knob 36 and the stopper plate 40, which is arranged on the lower end portion of the guide shaft 38, thereby fixing the slide unit 34 to the rail unit 32.

On the other hand, when the fixing knob 36 is raised, as shown in FIG. 4A, then the guide shaft 38 is pressed down and the gripping action between the stopper plate 40 and the fixing knob 36 is released. Thereby, the fixing of the slide unit 34 is released and the slide unit 34 is supported slidably with respect to the rail unit 32.

Each of the front side plate guides 30 has the composition described above. The front side plate 18 is fixed to the vertical sections 34B of the slide units 34. Thus, the front side plate 18 is arranged movably in the front-rear direction of the table 12.

A plurality of slit-shaped ventilation openings 18A are formed in the front side plate 18 to allow the air flow blown from the air blowers 16A to 16E to escape. In the present embodiment, the air blowing openings 18A are formed in the slit shape; however, the shape of the openings is not limited in particular and can be formed as a circular shape, for example. Moreover, in the present embodiment, the slits are formed vertically; however, it is also possible to form the slits horizontally or in an inclined fashion. Furthermore, in the present embodiment, the ventilation opening sections 18A are each formed with the same shape; however, it is also possible to vary the shapes of the ventilation opening sections 18A (for example, the lengths of the slits can be altered, and the slits can be mixed with circular holes).

As described above, the rear side plate 14E is composed by the rear side section 14E of the casing 14 (in other words, the rear side section 14E of the casing 14 also serves as the rear side plate). When the table 12 is accommodated in the casing 14, the rear-side face of the table 12 is in tight contact with the inner wall surface of the rear side section 14E of the casing 14.

A pair of paper holding plates 20 which support the rear end of the paper stack S loaded on the table 12 when the table 12 is pulled out are arranged at prescribed intervals apart in the rear end portion of the table 12. The paper holding plates 20 are formed in a rectangular thin plate shape, and are arranged in parallel with the front side plate 18. A pair of recess sections 44 in which the pair of paper holding plates 20 are accommodated when the table 12 is accommodated in the casing 14 are formed in the inner wall surface of the rear side plate (the rear section of the casing 14) 14E.

The left-hand side plate 22 is formed in a rectangular plate shape having substantially the same height as the front side plate 18, and is capable of extending and contracting in the front-rear direction of the table 12. The left-hand side plate 22 is constituted of a fixed plate section 22A formed in a hollow plate shape and a movable plate section 22B arranged slidably on the inner side of the fixed plate section 22A (in a so-called nested structure); the total width of the left-hand side plate 22 can be extended or contracted by sliding the movable plate section 22B with respect to the fixed plate section 22A.

The left-hand side plate 22 is arranged movably in the right-left direction of the table 12 by means of a pair of left-hand side plate guides 50. The composition of the left-hand side plate guides 50 is the same as that of the front side plate guides 30 described above. More specifically, each of the left-hand side plate guides 50 includes: a rail unit 52; a slide unit 54, which is guided linearly by the rail unit 52; and a fixing knob 56, which fixes the slide unit 54. The rail units 52 are arranged in the guiding direction of the left-hand side plate 22 (the right-left direction of the table 12 (the direction perpendicular to the left-hand side plate 22)), and the slide units 54 are arranged movably in the guiding direction of the left-hand side plate 22 by being guided by the rail units 52.

The fixed plate section 22A of the left-hand side plate 22 is installed on the slide units 54 of the left-hand side plate guides 50, and thereby the left-hand side plate 22 is arranged movably in the right-left direction of the table 12.

Furthermore, a left-front side plate engaging section 58 engaging with the front side plate 18 is formed in the front end of the left-hand side plate 22 (the front end of the fixed plate section 22A). The left-front plate engaging section 58 is formed vertically on the front end portion of the left-hand side plate 22 as an opening having a width which is substantially equal to the thickness of the front side plate 18. The front side plate 18 is inserted in the left-front side plate engaging section 58 and is thereby engaged with the left-hand side plate 22.

When the front side plate 18 is moved forward or rearward in a state where the front side plate 18 is inserted in the left-front side plate engaging section 58, the movable plate section 22B of the left-hand side plate 22 engaged with the front side plate 18 also moves forward or rearward in conjunction with the forward or rearward movement of the front side plate 18, thereby extending or contracting the overall size of the left-hand side plate 22.

Similarly to the left-hand side plate 22, the right-hand side plate 24 is formed in a rectangular plate shape having substantially the same height as the front side plate 18, and is capable of extending and contracting in the front-rear direction of the table 12. The composition of the right-hand side plate 24 is the same as the left-hand side plate 22. More specifically, the right-hand side plate 24 includes a fixed plate section 24A formed in a hollow plate shape and a movable plate section 24B arranged slidably on the inner side of the fixed plate section 24A, and the total size of the right-hand side plate 24 can be extended or contracted by sliding the movable plate section 24B with respect to the fixed plate section 24A.

The right-hand side plate 24 is arranged movably in the right-left direction of the table 12 by means of a pair of right-hand side plate guides 60. Similarly to the left-hand side plate guides 50, the composition of the right-hand side plate guides 60 is the same as that of the front side plate guides 30 described above. More specifically, each of the right-hand side plate guides 60 includes: a rail unit 62; a slide unit 64, which is guided linearly by the rail unit 62; and a fixing knob 66, which fixes the slide unit 64. The rail units 62 are arranged in the guiding direction of the right-hand side plate 24 (the right-left direction of the table 12 (the direction perpendicular to the right-hand side plate 24)), and the slide units 64 are arranged movably in the guiding direction of the right-hand side plate 24 by being guided by the rail units 62.

The fixed plate section 24A of the right-hand side plate 24 is installed on the slide units 64 of the right-hand side plate guides 60, and thereby the right-hand side plate 24 is arranged movably in the right-left direction of the table 12.

Furthermore, a right-front side plate engaging section 68 engaging with the front side plate 18 is formed in the front end of the right-hand side plate 24 (the front end of the fixed plate section 24A). Similarly to the left-front side plate engaging section 58 formed in the left-hand side plate 22, the right-front side plate engaging section 68 is formed vertically on the front end portion of the right-hand side plate 24 as an opening having a width which is substantially equal to the thickness of the front side plate 18. The front side plate 18 is inserted in the right-front side plate engaging section 68 and is thereby engaged with the right-hand side plate 24.

When the front side plate 18 is moved forward or rearward in a state where the front side plate 18 is inserted in the right-front side plate engaging section 68, the movable plate section 24B of the right-hand side plate 24 engaged with the front side plate 18 also moves forward or rearward in conjunction with the forward or rearward movement of the front side plate 18, thereby extending or contracting the overall size of the right-hand side plate 24.

The action of the seasoning apparatus 10 according to the present embodiment which has the composition described above is as follows.

Figure 5A:
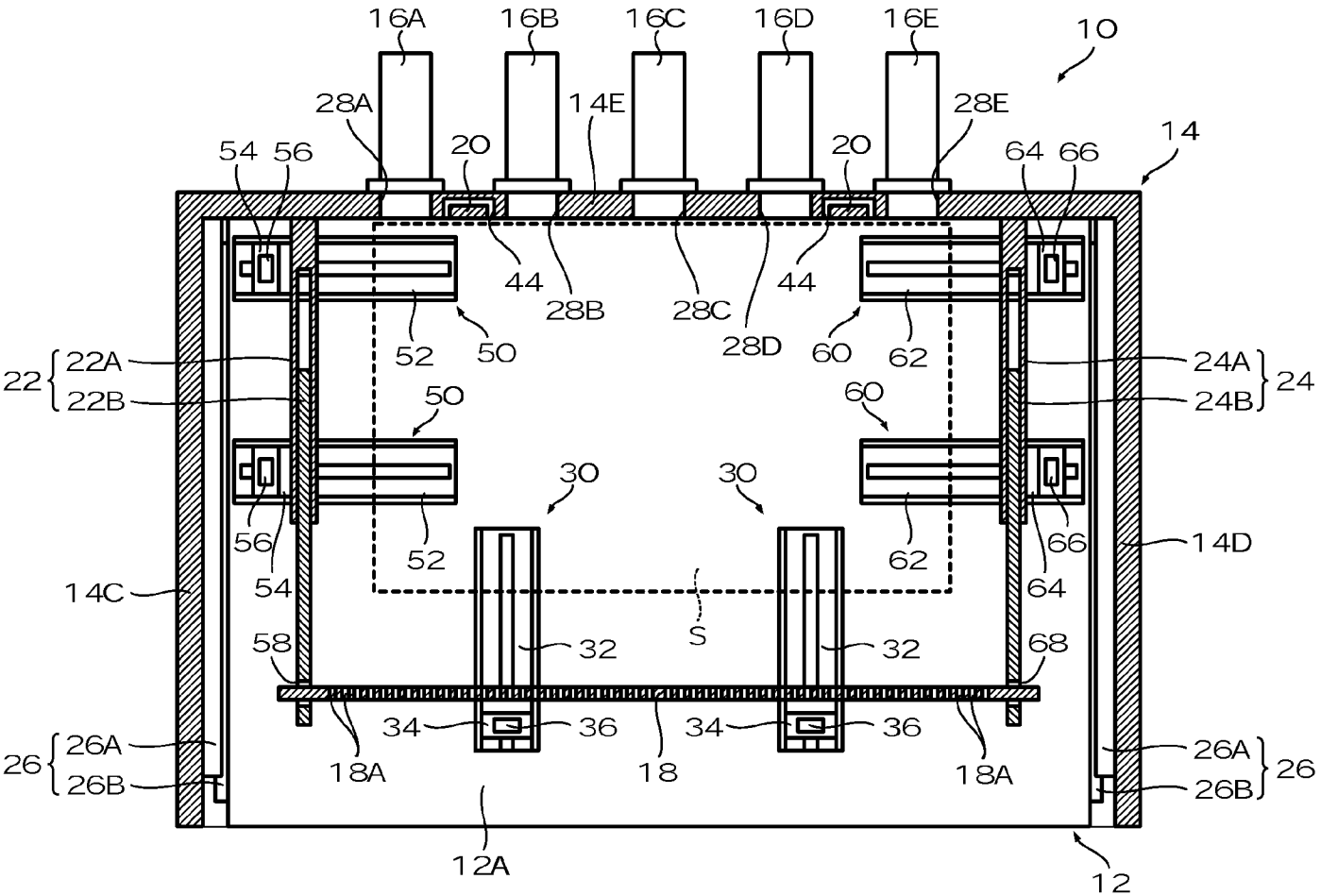
FIGS. 5A and 5B are illustrative diagrams of the action of the seasoning apparatus according to the first embodiment.

FIG. 5A shows a state where the table 12 is accommodated in the casing 14. As shown in FIG. 5A, when the table 12 is accommodated in the casing 14, the rear-side face of the table 12 is in tight contact with the inner wall surface of the rear side section 14E of the casing 14. Thus, the rear portion of the table 12 is covered with the rear side section 14E of the casing 14, and the rear side section 14E of the casing 14 functions as the rear side plate.

Furthermore, the upper portion of the table 12 is covered with the ceiling section 14B of the casing 14 when the table 12 is accommodated in the casing 14 (see FIG. 3). The rectangular space surrounded by the front side plate 18, the rear side plate (the rear side section of the casing 14) 14E, the left-hand side plate 22 and the right-hand side plate 24 is formed in the space between the table 12 and the ceiling section 14B of the casing 14. This rectangular space is a loading space for the paper stack S.

Figure 5B:
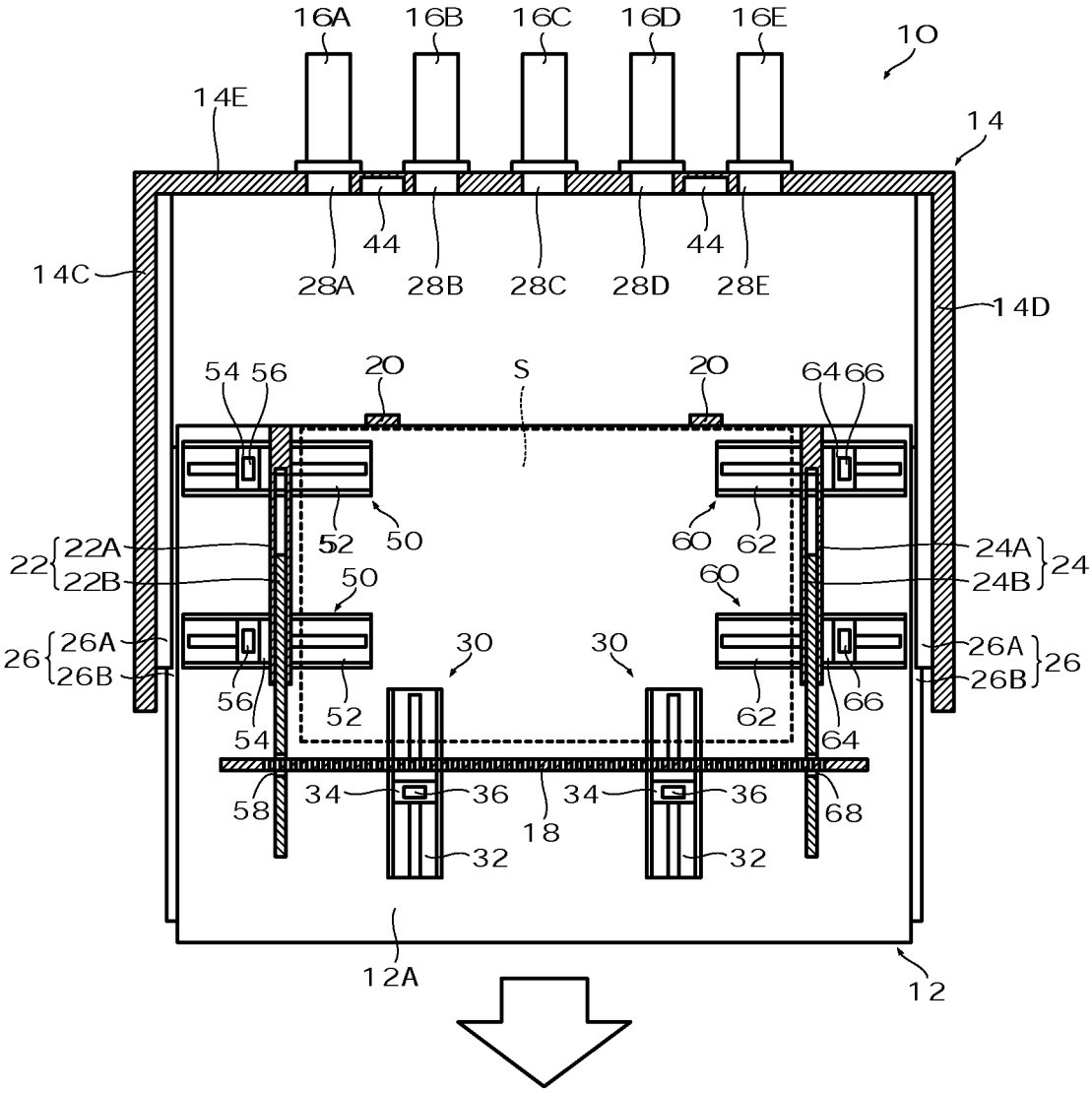

When an operator sets a paper stack S, firstly, the operator pulls out the table 12 from the casing 14, as shown in FIG. 5B. Thereby, the upper part of the table 12 is exposed.

Thereupon, the operator raises the fixed knobs 36 of the front side plate guides 30, thereby unlocking the sliding units 34. Thus, the front side plate 18 becomes movable in the forward and rearward directions. In this state, the front side plate 18 is retracted from the paper holding plate 20 to increase the interval between the front side plate 18 and the paper holding plate 20.

Similarly, the operator raises the fixing knobs 56 of the left-hand side guides 50, thereby unlocking the slide units 54, and raises the fixing knobs 66 of the right-hand side plate guides 60, thereby unlocking the slide units 64. The interval between the left-hand side plate 22 and the right-hand side plate 24 is then increased.

Next, the operator loads a paper stack S on the table 12. In this action, the operator loads the paper stack S in such a manner that the rear side face of the paper stack S abuts against the paper holding plate 20, which is disposed in the rear end portion of the table 12.

Next, the operator adjusts the positions of the front side plate 18, the left-hand side plate 22 and the right-hand side plate 24. More specifically, the front side plate 18, the left-hand side plate 22 and the right-hand side plate 24 are respectively disposed at positions distanced by approximately 3 mm from the side faces of the paper stack S.

The front side plate 18 is advanced toward the front side face of the paper stack S and is halted at a position approximately 3 mm from the front side face of the paper stack S. Here, since the left-hand end portion and right-hand end portion of the front side plate 18 engage with the left-front side plate engaging section 58 of the left-hand side plate 22 and the right-front side plate engaging section 68 of the right-hand side plate 24, then when the front side plate 18 is moved forward or rearward, the left-hand side plate 22 and the right-hand side plate 24 respectively extend and contract in conjunction with the forward or rearward movement of the front side plate 18. The front side plate 18 is halted at the position approximately 3 mm from the front side face of the paper stack S and is then locked. More specifically, the fixing knobs 36 are lowered, thereby locking the slide units 34.

After adjusting the position of the front side plate 18, the positions of the left-hand side plate 22 and the right-hand side plate 24 are adjusted. Firstly, the left-hand side plate 22 is advanced toward the left-hand side face of the paper stack S and is halted at a position approximately 3 mm from the left-hand side face of the paper stack S. The left-hand side plate 22 is then locked in this position. Similarly, the right-hand side plate 24 is advanced toward the right-hand side face of the paper stack S and is halted at a position approximately 3 mm from the right-hand side face of the paper stack S. The right-hand side plate 24 is then locked in this position.

With the foregoing, the setting of the paper stack S is completed. The operator then pushes the table 12 back to the casing 14 so that it is accommodated in the casing 14.

When the table 12 is accommodated in the casing 14, the four peripheral faces of the paper stack S loaded on the table 12 are surrounded by the side plates, and the upper portion of the table 12 is covered with the ceiling section 14B of the casing 14. In other words, the table 12 is substantially enclosed.

Thereupon, the operator instructs the seasoning apparatus 10 to start a seasoning process through the operating unit (not shown).

When the start of a seasoning process is instructed, the air blowers 16A to 16E are driven and ambient air is blown at a prescribed flow rate from the air blowers 16A to 16E. The ambient air flow blown from the air blowers 16A to 16E enters horizontally into the casing 14 from the air blowing opening sections 28A to 28E, which are formed in the rear side section (rear side plate) 14E of the casing 14. The ambient air flow blown into the casing 14 passes between the sheets of stacked paper and exits through the ventilation opening sections 18A formed in the front side plate 18. Seasoning is promoted due to the ambient air flow being blown between the paper sheets.

The air blowing is performed from the air blowers 16A to 16E continuously for a prescribed period of time. The air blowing time (seasoning time) is set in accordance with the type of paper, the number of sheets, printing conditions, and the like, and a sufficient time required for seasoning all of the paper sheets is set. When the prescribed period of time has passed after the start of air blowing, the driving of the air blowers 16A to 16E is halted to stop the air blowing, and the seasoning is thereby completed.

The operator then pulls out the table 12 from the casing 14 and recovers the paper stack S, which has completed seasoning. Firstly, the operator raises the fixing knobs 36 of the front side plate guides 30 to unlock the slide units 34, and thereby the front side plate 18 becomes movable in the forward and rearward directions. In this state, the front side plate 18 is retracted from the front side face of the paper stack S. Thereupon, the operator raises the fixing knobs 56 of the left-hand side plate guides 50 to unlock the slide units 54, and raises the fixing knobs 66 of the right-hand side plate guides 60 to unlock the slide units 64. Thereby, the left-hand side plate 22 and the right-hand side plate 24 become movable. In this state, the interval between the left-hand side plate 22 and the right-hand side plate 24 is increased. By means of the foregoing, space is formed at the front, left-hand and right-hand sides of the paper stack S, and the paper stack S can be recovered.

The operator recovers the paper stack S from the table 12. When subsequently performing seasoning of a further paper stack S, the paper stack S to be processed is loaded onto the table 12, the positions of the front side plate 18, the left-hand side plate 22 and the right-hand side plate 24 are adjusted by the procedure described above, and seasoning is carried out.

As described above, according to the seasoning apparatus 10 of the present embodiment, the front side plate 18 is arranged movably in the frontward and rearward directions, and the left-hand side plate 22 and the right-hand side plate 24 are arranged in a mutually advanceable and retractable fashion, whereby the positions thereof can be adjusted in accordance with the size of the paper stack S. Hence, it is possible to position the side plates suitably, and seasoning can be performed efficiently. Moreover, the paper stack S after completing seasoning can be kept ordered tidily and the paper stack S can be recovered easily. Furthermore, by adopting the composition in which the table 12 is formed so that it can be pulled out from the casing 14, and the upper portion of the table 12 is covered by accommodating the table 12 in the casing 14, then it is possible to cover the upper portion of the paper stack S in a simple fashion and the enclosed space can be formed readily.

In the present embodiment, the rear side section 14E of the casing 14 also serves as the rear side plate; however, it is also possible to arrange a rear side plate separately from the rear side section 14E of the casing 14. More specifically, it is also possible to adopt a composition in which a rear side plate is arranged directly on the table 12.

Second Embodiment

Figure 6:
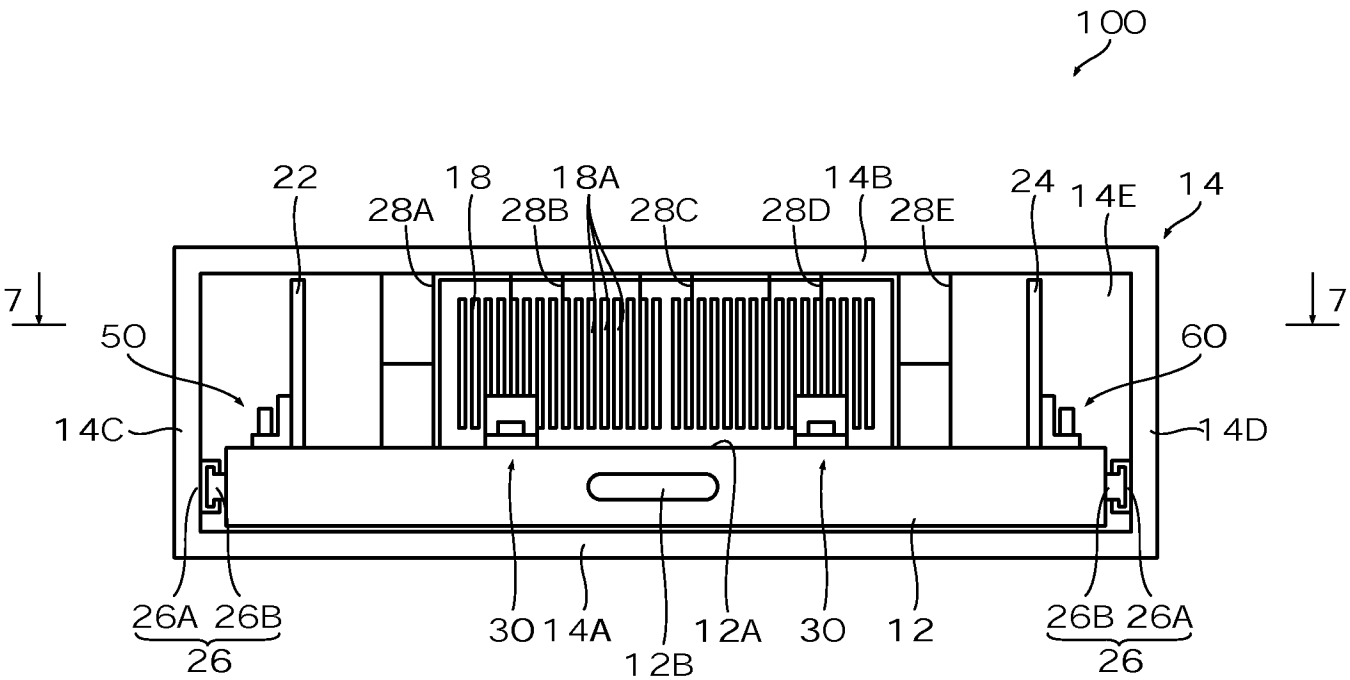
FIG. 6 is a front view diagram of a seasoning apparatus according to a second embodiment of the present invention.
Figure 7:
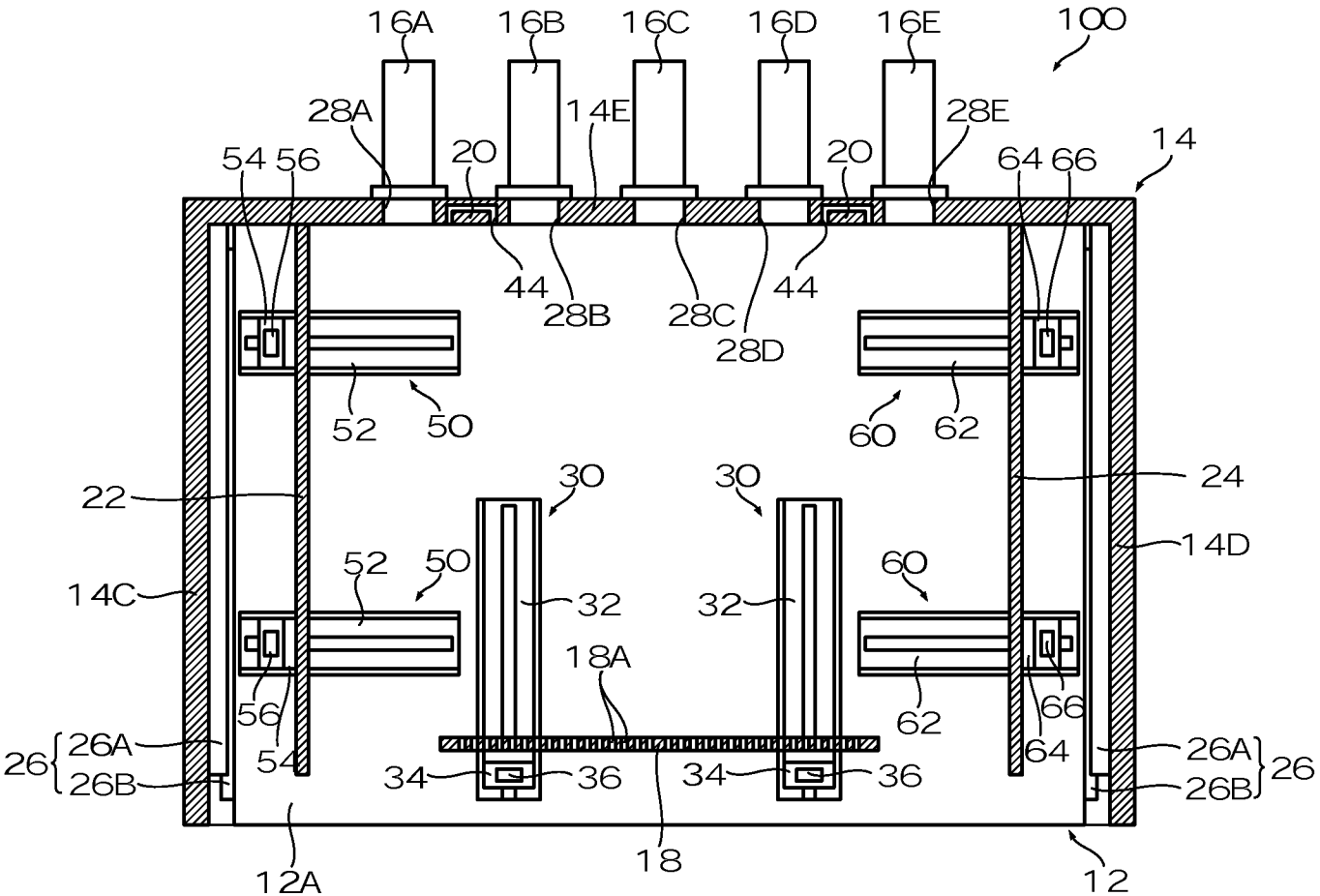
FIG. 7 is a cross-sectional view along line 7-7 in FIG. 6.

FIG. 6 is a front diagram of a seasoning apparatus according to a second embodiment of the present invention, and FIG. 7 is a cross-sectional diagram along line 7-7 in FIG. 6.

In the seasoning apparatus 10 according to the first embodiment described above, the left-hand side plate 22 and the right-hand side plate 24 are capable of extending and contracting, and the front end portions thereof engage with the front side plate 18 in such a manner that the left-hand side plate 22 and the right-hand side plate 24 extend and contract in conjunction with forward and rearward movement of the front side plate 18. On the other hand, in the seasoning apparatus 100 according to the second embodiment, each of the left-hand side plate 22 and the right-hand side plate 24 is constituted of a single plate, and does not extend or contract. Moreover, the engagement of the left-hand side plate 22 and the right-hand side plate 24 with the front side plate 18 is released, in such a manner that the left-hand side plate 22 and the right-hand side plate 24 can move independently.

In this case, gaps can be formed on the left-hand side and the right-hand side of the front side plate 18, and these gaps (openings) function as ventilation sections through which the air flow passes. In other words, the ambient air flow blown from the air blowers 16A to 16E passes through the interior of the casing 14 and exits the casing 14 through the ventilation opening sections 18A formed in the front side plate 18, as well as exiting the casing 14 through the gaps (openings) on the left-hand side and the right-hand side of the front side plate 18.

Even if the paper stack is not in a completely enclosed state but rather the substantially enclosed state in this way, it is still possible to season the paper stack S efficiently. In particular, by forming opening sections on the downstream side of the air blowing direction by the air blowers 16A to 16E (in the surface that opposes the air blowers 16A to 16E), it is possible to pass the air flow efficiently and the paper stack S can be seasoned efficiently.

Third Embodiment

Figure 8:
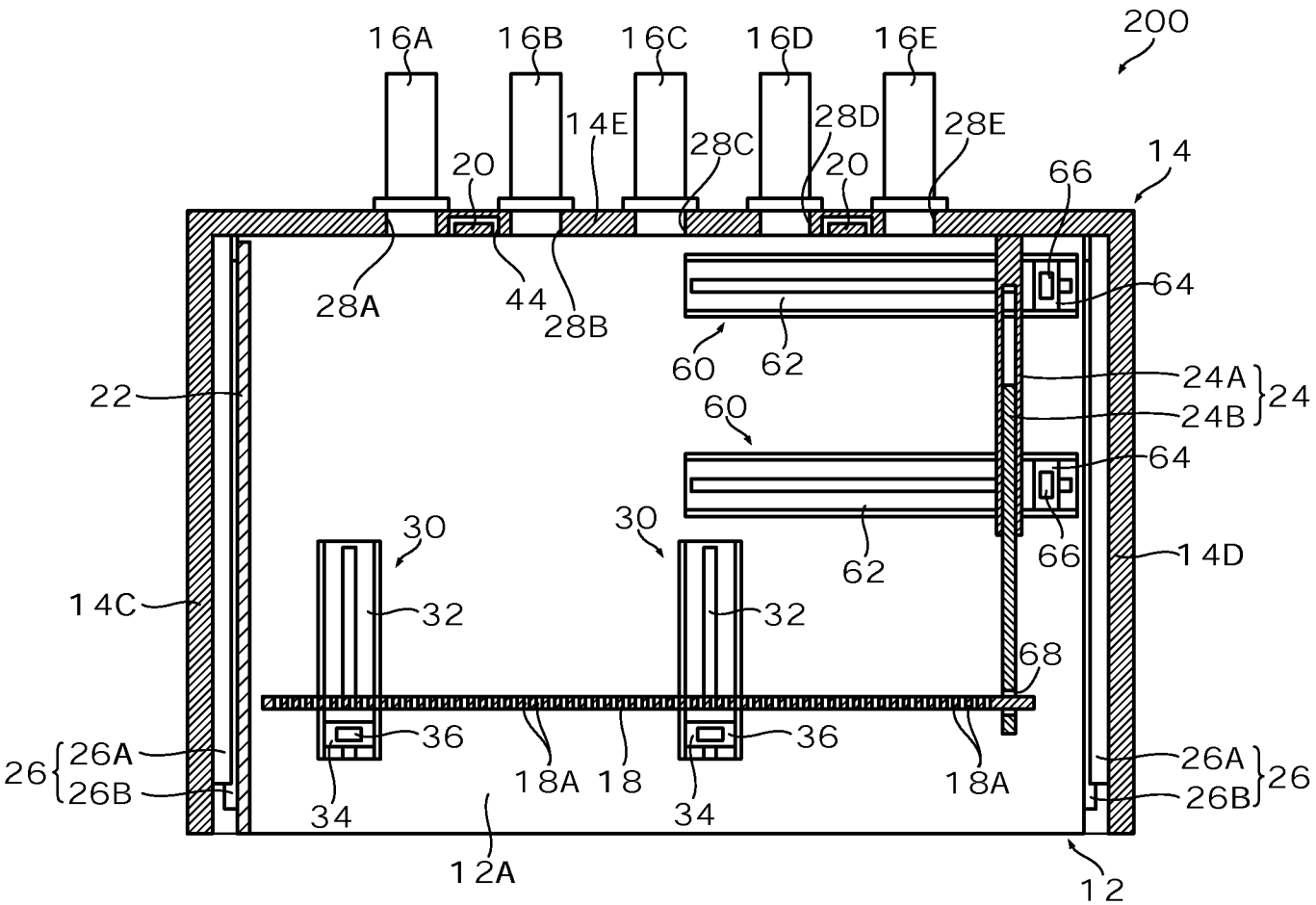
FIG. 8 is a plan view cross-sectional diagram of a seasoning apparatus according to a third embodiment of the present invention.

FIG. 8 is a plan view cross-sectional diagram of a seasoning apparatus according to a third embodiment of the present invention.

As shown in FIG. 8, the seasoning apparatus 200 according to the third embodiment is a modification of the seasoning apparatus 10 of the first embodiment described above, in which the left-hand side plate 22 is fixed to the table 12.

The left-hand side plate 22 is constituted of a single plate and is erected vertically along the left-hand side portion of the table 12. The left-hand side plate 22 is fixed on the table 12, and there is no engagement between the left-hand side plate 22 and the front side plate 18. Consequently, the front side plate 18 is engaged only with the right-hand side plate 24.

In the seasoning apparatus 200 according to the composition described above, it is possible to position the side plates in accordance with the size of the paper. More specifically, since the front side plate 18 is arranged to capable of advancing and retracting with respect to the rear side plate (the rear side section of the casing 14) 14E, and furthermore, the right-hand side plate 24 is arranged to capable of advancing and retracting with respect to the left-hand side plate 22, then it is possible to adjust the intervals on the front, rear, left-hand and right-hand sides of the paper stack S. Consequently, it is possible to arrange the side plates at suitable positions in accordance with the size of the paper. Thus, it is possible to enclose the periphery of the paper stack S, and the paper stack S can be seasoned with good efficiency.

Fourth Embodiment

Figure 9:
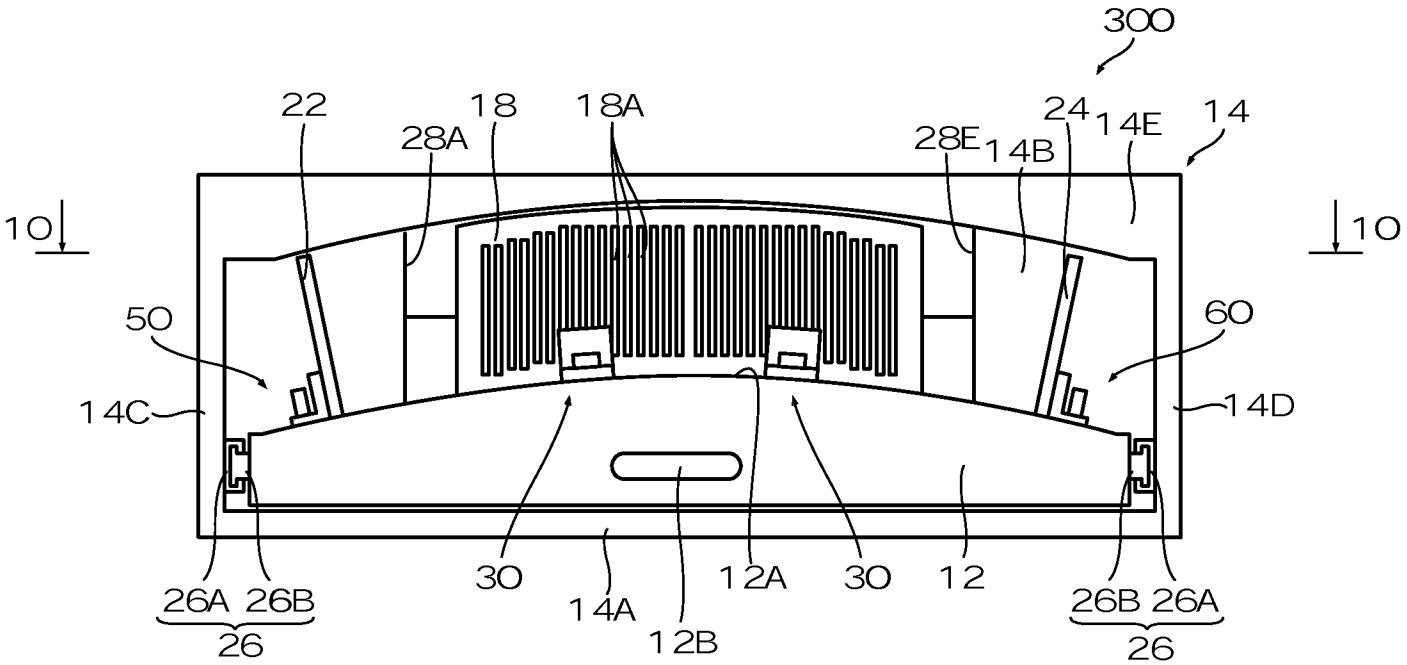
FIG. 9 is a front view diagram of a seasoning apparatus according to a fourth embodiment of the present invention.
Figure 10:
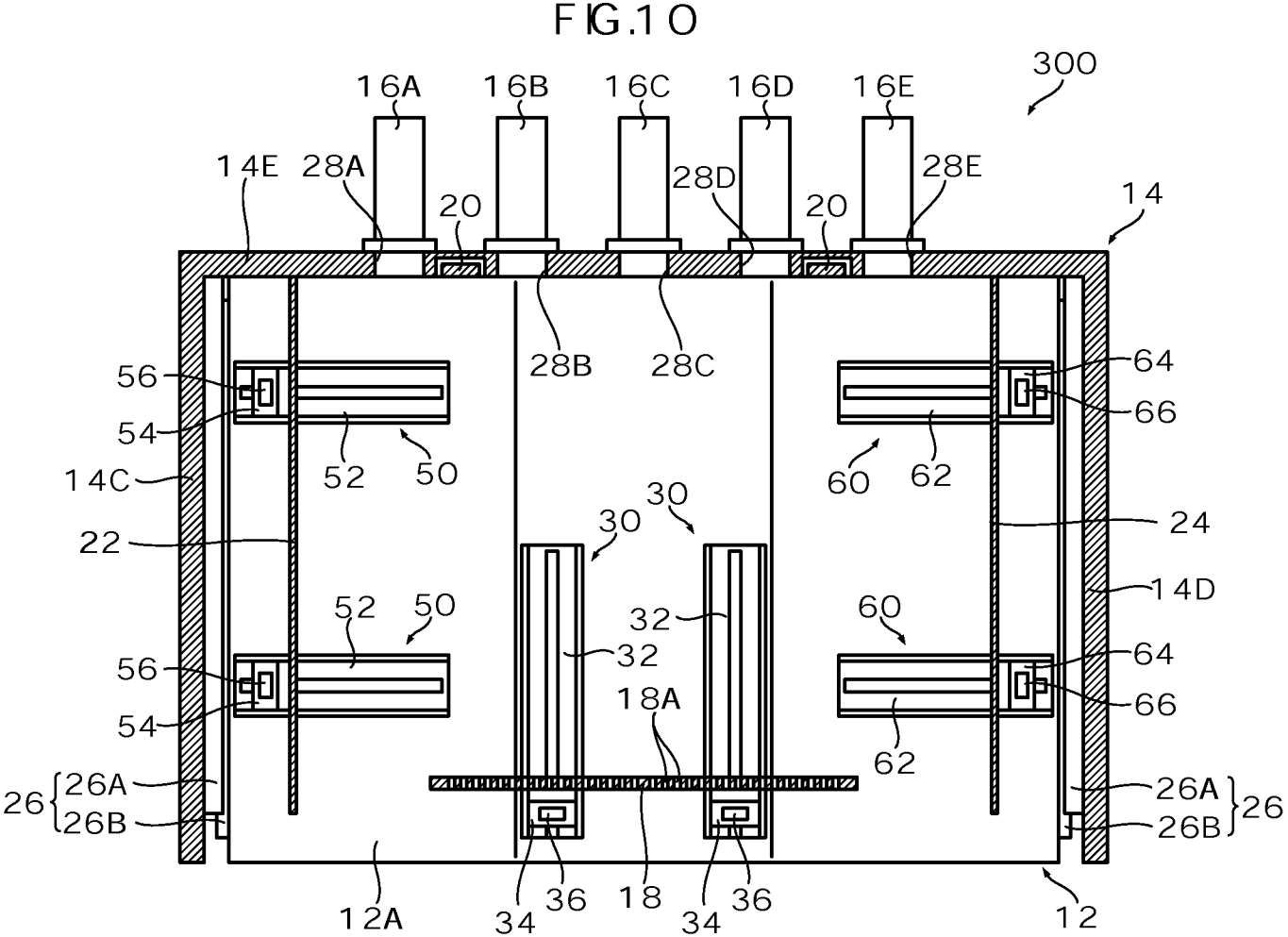
FIG. 10 is a cross-sectional view along line 10-10 in FIG. 9.

FIG. 9 is a front view diagram of a seasoning apparatus according to a fourth embodiment of the present invention, and FIG. 10 is a cross-sectional diagram along line 10-10 in FIG. 9.

The seasoning apparatus 300 according to the fourth embodiment is a modification of the seasoning apparatus 100 of the second embodiment described above, wherein the loading surface 12A of the table 12 is curved in an arch shape in the right-left directions (namely, is curved in an upward convex shape).

By curving the loading surface 12A of the table 12 in the arch shape in this way, it is possible to season the paper stack S more efficiently. More specifically, if the loading surface 12A of the table 12 is curved, as shown in FIG. 11, the paper stack S curves in an arch shape in accordance with the loading surface 12A of the table 12 and the direction of curve is uniform for all of the paper sheets, thus making it possible to pass the air flow between the paper sheets in a suitable fashion.

When the loading surface 12A of the table 12 is curved with the object of achieving such an action, the direction of curve is set to be perpendicular to the direction of air blowing by the air blowers 16A to 16E. In the fourth embodiment, the air is blown from the rear toward the front, and therefore the loading surface is curved in the right-left direction.

Figure 11:
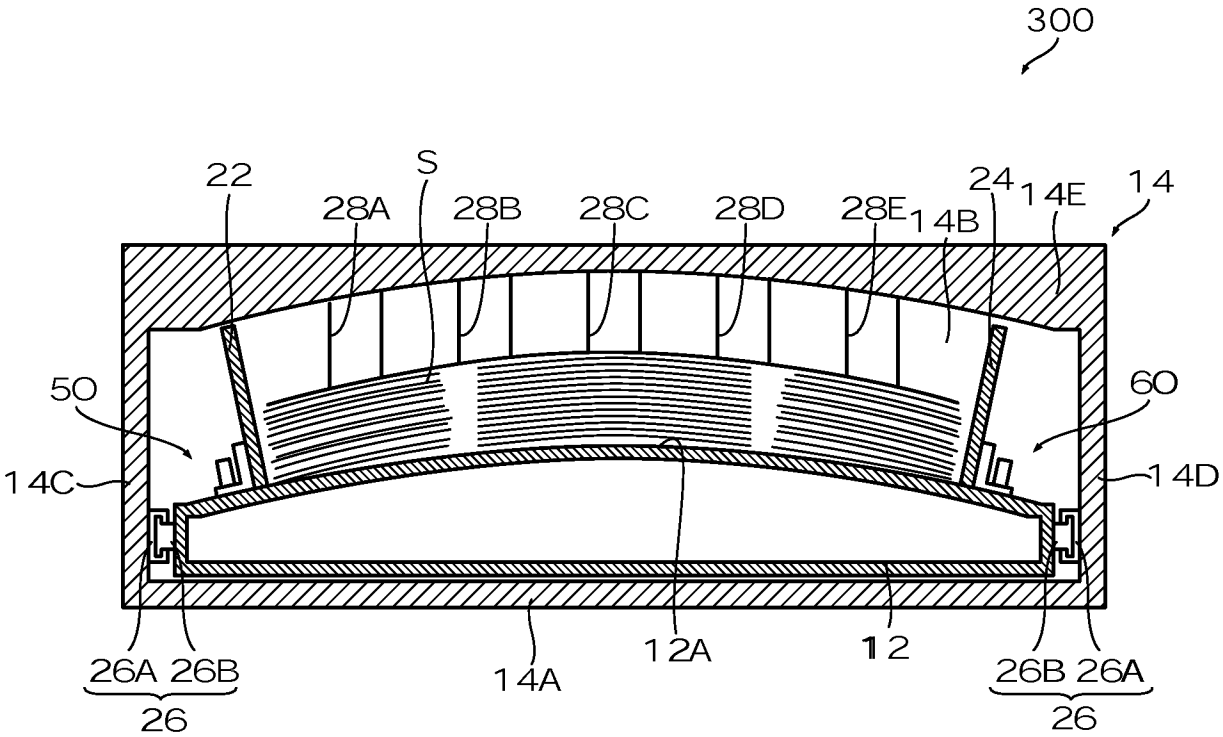
FIG. 11 is an illustrative diagram of the action of the seasoning apparatus according to the fourth embodiment.

Moreover, when the loading surface 12A of the table 12 is curved in this way, then as shown in FIGS. 9 and 11, the ceiling plate section 14B of the casing 14 can be curved so as to correspond to the curvature of the loading surface 12A. In this case, it is possible to form the whole of the ceiling plate section in a curved shape, or as in the present embodiment, to form only the inner surface of the ceiling plate section 14B in a curved shape.

Furthermore, the front side plate 18 can be also formed in a curved shape, so as to correspond to the curvature of the loading surface 12A of the table 12 and the ceiling plate section 14B.

In the fourth embodiment, the modification of the seasoning apparatus 100 according to the second embodiment shown in FIG. 6 is composed in such a manner that the loading table 12A of the table 12 is curved; however, it is also possible to form the loading surface 12A similarly in a curved shape, in the seasoning apparatus 10 according to the first embodiment shown in FIG. 1. By this means, it is possible to raise enclosing properties.

Fifth Embodiment

Figure 12:
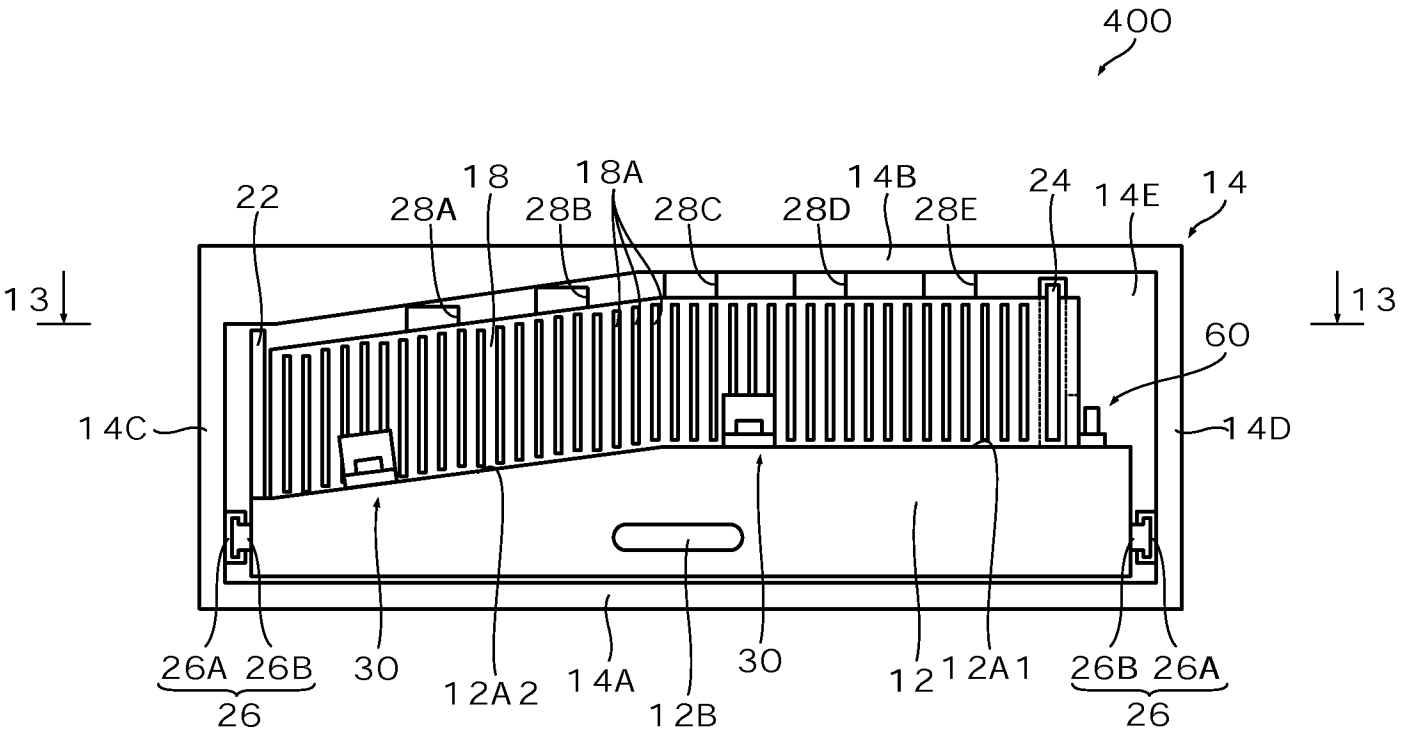
FIG. 12 is a front view diagram of a seasoning apparatus according to a fifth embodiment of the present invention.
Figure 13:
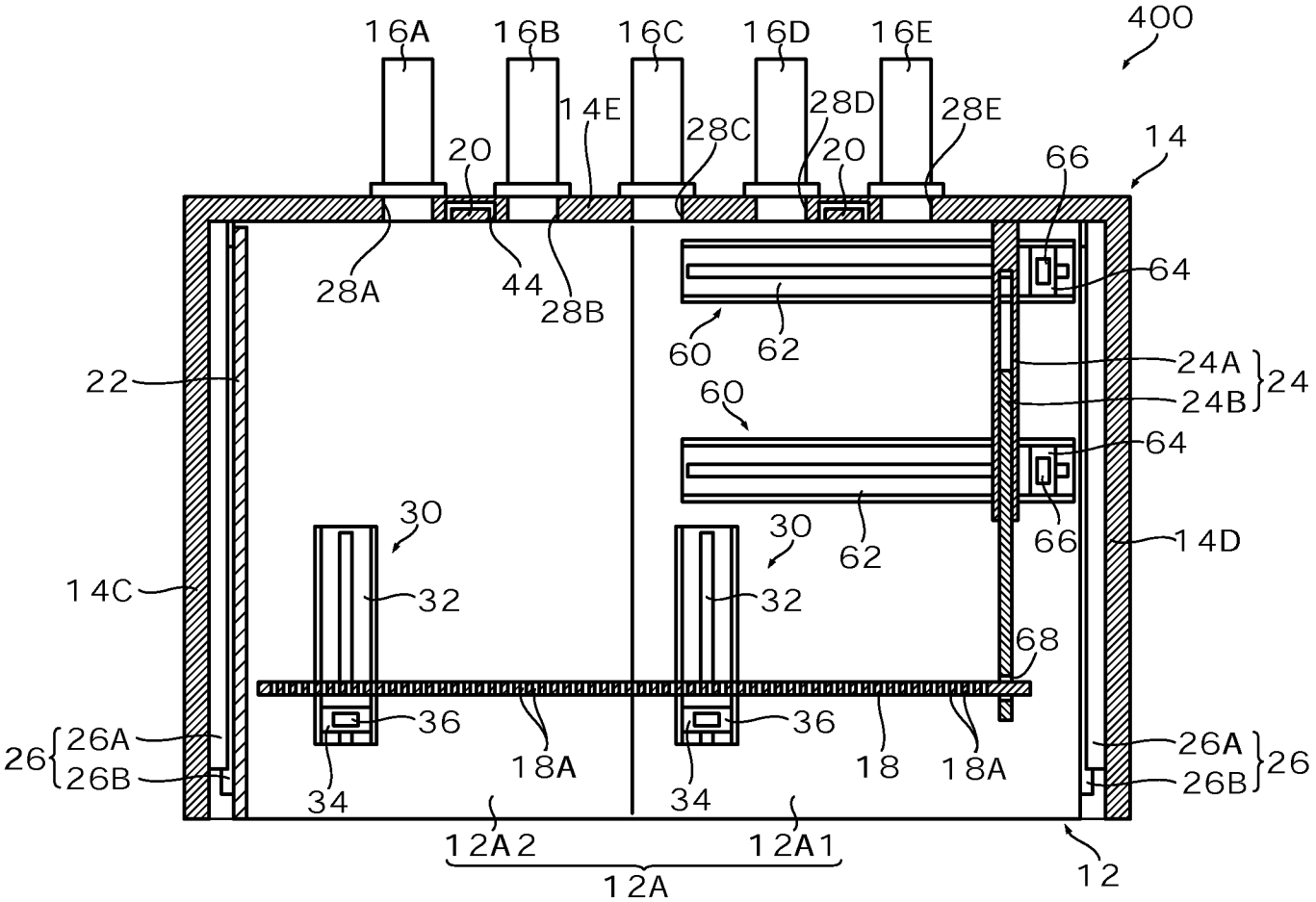
FIG. 13 is a cross-sectional view along line 13-13 in FIG. 12.

FIG. 12 is a front view diagram of a seasoning apparatus according to a fifth embodiment of the present invention, and FIG. 13 is a cross-sectional diagram along line 13-13 in FIG. 12.

The seasoning apparatus 400 according to the fifth embodiment is a modification of the seasoning apparatus 200 according to the third embodiment described above, wherein one side (the left-hand side) of the loading surface 12A of the table 12 is formed to be inclined.

As shown in FIG. 12, the loading surface 12A of the table 12 includes a horizontal flat section 12A1 and an inclined section 12A2, which is inclined downward, and the right-hand half of the loading surface 12A forms the flat section 12A1 and the left-hand half of the loading surface 12A forms the inclined section 12A2.

By forming the table 12 with one side thus inclined, it is possible to make the direction of curve of all of the paper sheets uniform and it is possible to pass the air flow suitably between the paper sheets, similarly to the seasoning apparatus 200 according to the third embodiment described above.

Figure 14:
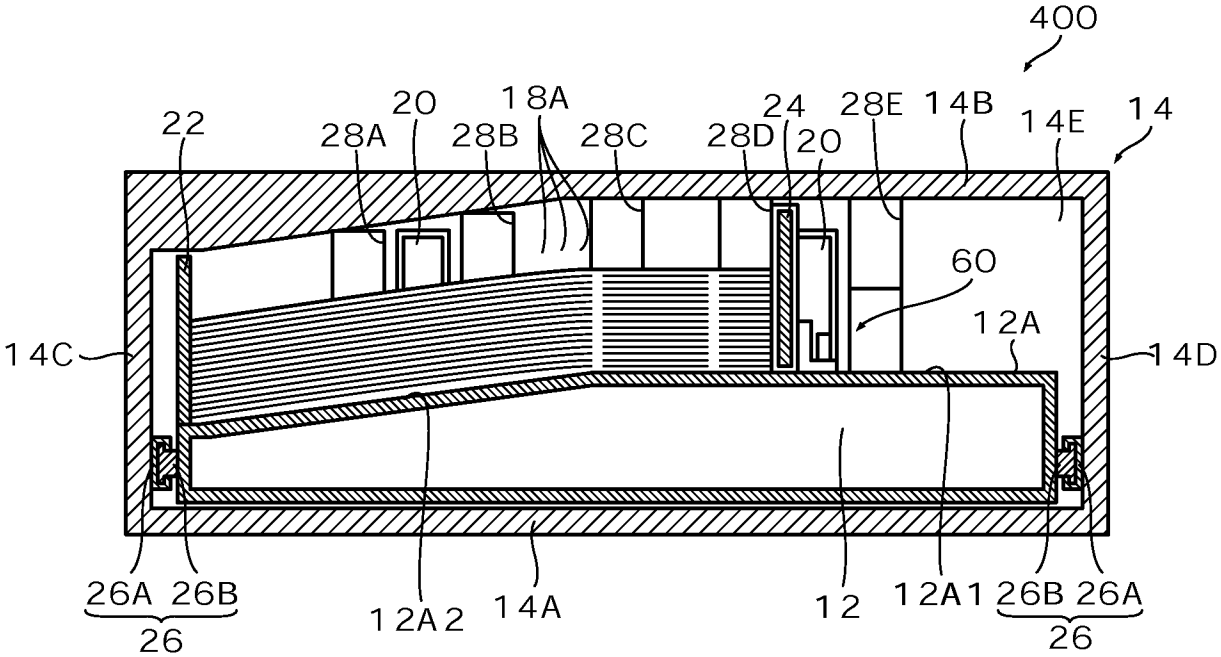
FIG. 14 is an illustrative diagram of the action of the seasoning apparatus according to the fifth embodiment.

Furthermore, by forming the table 12 with one side inclined, it is possible to order the paper sheets at the end of seasoning. More specifically, during seasoning, the paper sheets float up due to the air flow from the air blowers 16A to 16E, and therefore become stacked in a disordered fashion if allowed to fall freely, but by forming one side of the table 12 inclined, as shown in FIG. 14, the left-hand edges of the paper sheets abut against the left-hand side plate 22 due to the weight of the paper sheets when the paper sheets fall, and therefore the paper sheets are stacked in an orderly and aligned fashion. Hence, it is possible to facilitate handling of the paper stack S after the end of seasoning.

In the seasoning apparatus 400 of the fifth embodiment, similarly to the seasoning apparatus 300 of the fourth embodiment described above, the direction in which the loading surface 12A of the table 12 is inclined is set to a direction perpendicular to the direction of the air blowing by the air blowers 16A to 16E. In the fifth embodiment, air is blown from the rear toward the front, and therefore the loading surface is inclined in either the leftward or rightward direction. In this case, if one of the side plates is fixed as in the seasoning apparatus 400 according to the fifth embodiment, in which the left-hand side plate 22 is fixed, then desirably the loading surface 12A is inclined downwardly toward the side of the side plate that is fixed.

Moreover, in the present embodiment, only one side of the loading surface 12A is inclined; however, it is also possible to adopt a composition in which the whole of the loading surface is inclined.

Further, when the loading surface 12A of the table 12 is inclined in this way, then as shown in FIGS. 12 and 14, the ceiling plate section 14B of the casing 14 can be inclined so as to correspond to the inclination of the loading surface 12A. In this case, it is possible to form the whole of the ceiling plate section in an inclined shape, or as in the present embodiment, to form only the inner surface of the ceiling plate section 14B in an inclined shape.

Furthermore, the front side plate 18 can be also formed in an inclined shape, so as to correspond to the inclination of the loading surface 12A of the table 12 and the ceiling plate section 14B.

In the fifth embodiment, the modification of the seasoning apparatus 200 according to the third embodiment shown in FIG. 8 is composed in such a manner that a part of the loading table 12A of the table 12 is inclined; however, it is also possible to form all or a part of the loading surface 12A similarly inclined, in the seasoning apparatus 10 according to the first embodiment shown in FIG. 1. By this means, it is possible to raise enclosing properties.

Sixth Embodiment

Figure 15:
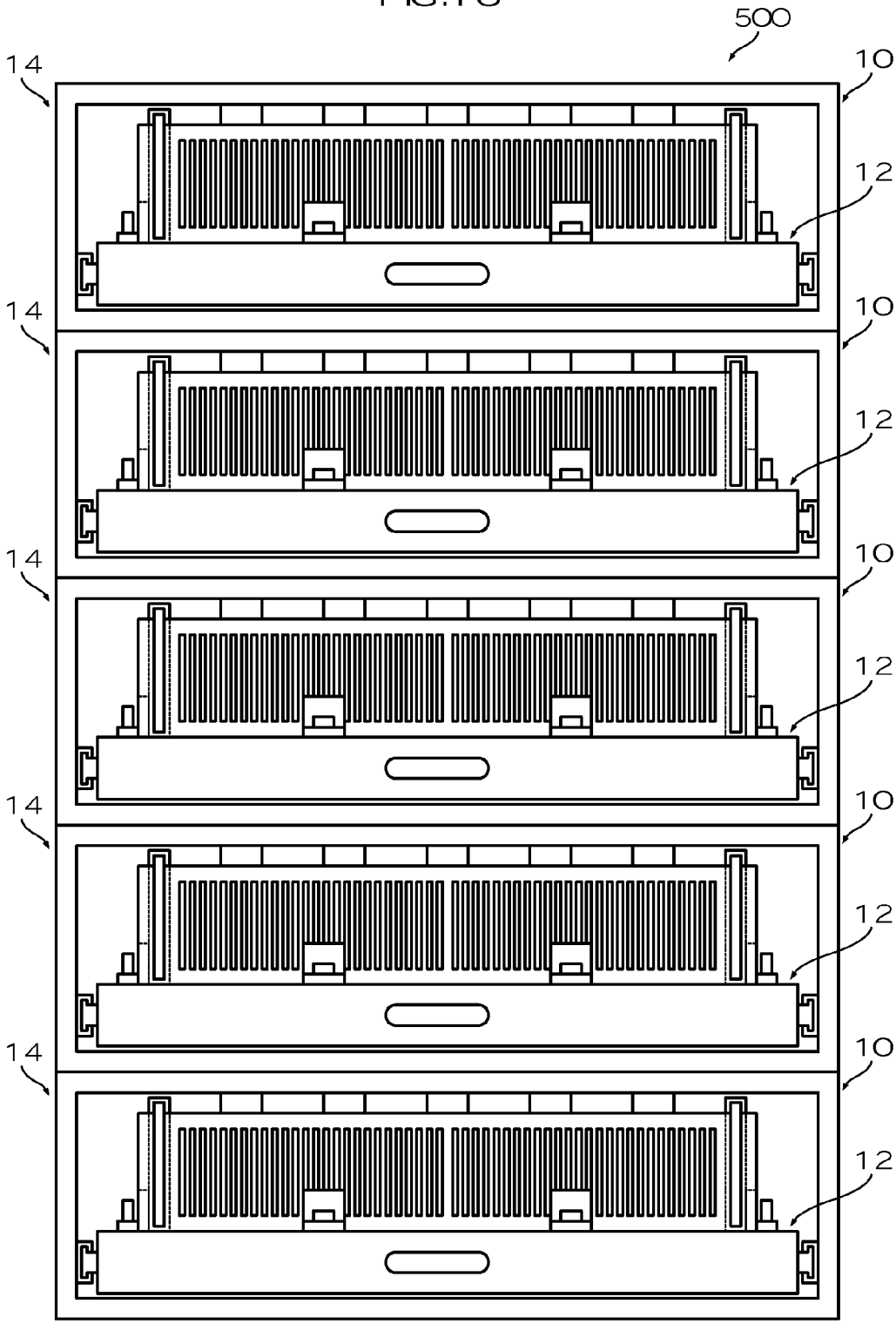
FIG. 15 is a front view diagram of a seasoning apparatus according to a sixth embodiment of the present invention.

FIG. 15 is a front view diagram of a seasoning apparatus according to a sixth embodiment of the present invention.

The seasoning apparatus 500 according to the sixth embodiment is a seasoning apparatus composed by stacked units, each unit being constituted of the seasoning apparatus 10 according to the first embodiment described above. As described above, in the seasoning apparatus 10 of the first embodiment, the casing 14 is formed in a box shape and therefore can be stacked. By this means, it is possible to process a large number of paper stacks simultaneously, without increasing the installation space.

It is also possible to similarly stack the seasoning apparatuses according to other embodiments, whereby a large number of paper stacks can be processed simultaneously.

Figure 16:
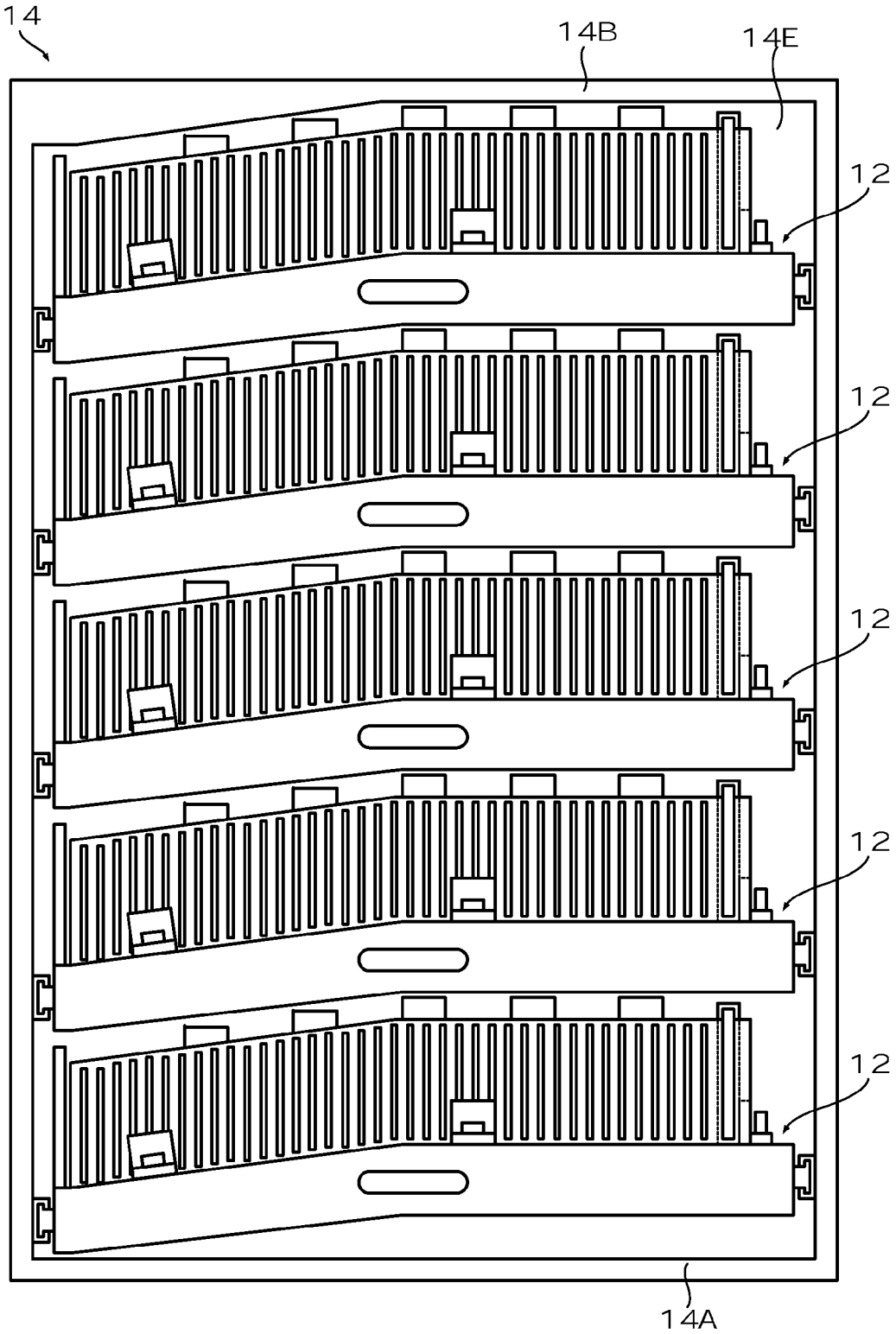
FIG. 16 is a front view diagram of a seasoning apparatus according to a further embodiment of the present invention.

FIG. 16 is a front view diagram showing a further embodiment of a case where the seasoning apparatuses are stacked. As shown in FIG. 16, the seasoning apparatuses can be accommodated in a single casing 14. In this case, the table of one seasoning apparatus located above another seasoning apparatus constitutes the ceiling of the seasoning apparatus located therebelow (and the upper surface of the casing 14 forms the ceiling plate section of the seasoning apparatus located in the uppermost position). Furthermore, the rear side section 14E of the casing 14 also serves as the rear side plates of all of the seasoning apparatuses. By this means, it is possible to restrict the overall height.

As shown in FIG. 16, when the loading surface of the table 12 is inclined or curved, the lower surface of the table 12 in an upper position is also inclined or curved.

Other Embodiments

In the series of embodiments described above, the air blowers 16A to 16E are fixed to the rear side section 14E of the casing 14; however, it is also preferable that the air blowers 16A to 16E are arranged movably in the lateral direction so that the intervals therebetween can be altered in accordance with the interval between the left-hand side plate and the right-hand side plate. In this case, it is possible to increase or reduce the intervals between the air blowers 16A to 16E in a uniform fashion, or the air blowers can be arranged at desired positions. In this case, the arrangement interval between the ventilation opening sections 28A to 28E is also changeable.

Furthermore, in the series of embodiments described above, the respective side plates are moved manually by the operator and set in desired positions, but it is also possible to adopt a composition where the side plates are moved electrically, by a motor, cylinder, or the like. In this case, a desirable composition is one where the side plates are moved automatically to positions corresponding to a paper size, when the paper size has been input.

The positions at which the side plates are to be located are determined in accordance with the sizes of the paper (positions approximately 3 mm to 10 mm from each edge of the paper), and desirably, the positions for locating the side plates are marked on the loading surface 12A of the table 12 for the sizes of paper.

Figure 17:
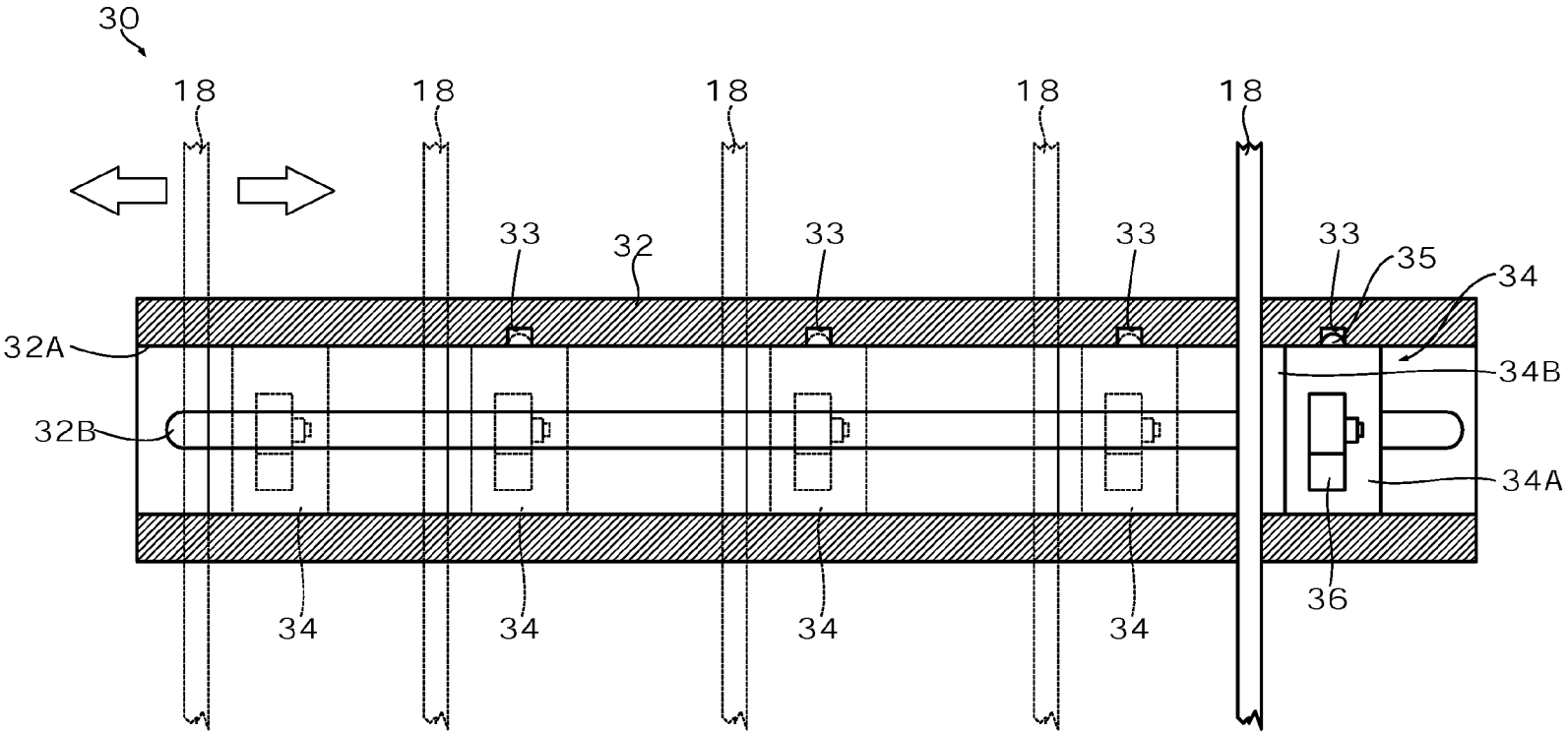
FIG. 17 is an approximate schematic drawing of a click mechanism.

Furthermore, desirably, the side plates are composed so as to move by intervals corresponding to the sizes of the paper. For example, a click mechanism is arranged in each of the slide units 34 as shown in FIG. 17, in such a manner that the slide unit 34 is halted at positions corresponding to the paper sizes. The click mechanism shown in FIG. 17 includes a pin 35 with a hemispherically formed top end that is arranged embeddably in a side face of the horizontal section 34A of the slide unit 34, the pin 35 is impelled in a projecting direction by a spring (not shown), and recess sections 33 formed in an inner wall surface of the guide groove 32A of the rail unit 32. The recess sections 33 are formed so as to correspond to positions where the side plate (here, the front side plate 18) is to be halted. By means of this composition, when the slide unit 34 is moved, the pin 35 fits into the recess section 33 at the prescribed position, thereby enabling the side plate (front side plate 18) to be halted in the desired position. When the slide unit 34 is moved by applying a prescribed load or more, the pin 35 is pushed in by means of the edge of the recess section 33, and the slide unit 34 becomes able to move. By providing a click mechanism of this kind, it is possible to halt the side plates in the desired positions corresponding to the paper sizes. Therefore, it is possible to set up the side plates more easily.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A seasoning apparatus, comprising:

a table having a loading surface on which a stack of paper sheets is loaded;

a ceiling plate which is arranged above the loading surface to cover an upper side of the stack of paper sheets loaded on the loading surface;

a front side plate and a rear side plate which are arranged to oppose to each other at a front side and a rear side of the stack of paper sheets loaded on the loading surface, at least one of the front side plate and the rear side plate being advanceable and retractable relatively to each other;

a right-hand side plate and a left-hand side plate which are arranged to oppose to each other at a right-hand side and a left-hand side of the stack of paper sheets loaded on the loading surface, at least one of the right-hand side plate and the left-hand side plate being advanceable and retractable relatively to each other; and an air blowing device which blows air horizontally toward the stack of paper sheets loaded on the loading surface.

2. The seasoning apparatus as defined in claim 1, further comprising a horizontal base, wherein:

the ceiling plate is fixed to the base; and the table is slidable horizontally with respect to the base.

3. The seasoning apparatus as defined in claim 1, wherein:

at least a part of the loading surface is formed so as to be inclined one of rightward and leftward; and the air blowing device blows air horizontally toward the stack of paper sheets loaded on the loading surface from the rear side of the stack of paper sheets loaded on the loading surface.

4. The seasoning apparatus as defined in claim 1, wherein:

the loading surface is formed so as to be curved rightward and leftward; and the air blowing device blows air horizontally toward the stack of paper sheets loaded on the loading surface from the rear side of the stack of paper sheets loaded on the loading surface.

5. The seasoning apparatus as defined in claim 1, wherein:

the rear side plate is fixed to the table; and the front side plate is advanceable and retractable with respect to the rear side plate.

6. The seasoning apparatus as defined in claim 5, wherein:

one of the left-hand side plate and the right-hand side plate is fixed to the table; and the other of the left-hand side plate and the right-hand side plate is advanceable and retractable with respect to the fixed one of the left-hand side plate and the right-hand side plate.

7. The seasoning apparatus as defined in claim 5, wherein both the left-hand side plate and the right-hand side plate are mutually advanceable and retractable.

8. The seasoning apparatus as defined in claim 1, wherein:

the air blowing device blows air horizontally toward the stack of paper sheets loaded on the loading surface from the rear side of the stack of paper sheets loaded on the loading surface; and an opening section through which the air blown from the air blowing device exits is formed in the front side plate.

9. The seasoning apparatus as defined in claim 1, wherein an interval between the front side plate and the rear side plate and an interval between the left-hand side plate and the right-hand side plate are variable in accordance with preset paper widths.

10. A seasoning apparatus, comprising a plurality of seasoning apparatuses each of which is defined in claim 1, the plurality of seasoning apparatuses being stacked to each other.

* * * * *